US010055921B2

(12) United States Patent
Shibata et al.

(10) Patent No.: US 10,055,921 B2
(45) Date of Patent: Aug. 21, 2018

(54) COIN PROCESSING APPARATUS

(71) Applicant: FUJI ELECTRIC CO., LTD., Kawasaki-shi, Kanagawa (JP)

(72) Inventors: Yoshito Shibata, Tsu (JP); Kazuhiro Tomita, Yokkaichi (JP); Takao Okuhara, Yokkaichi (JP); Takuya Fukuura, Yokkaichi (JP); Katsuya Nakajima, Nagano (JP); Norio Nakajima, Yokkaichi (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 9 days.

(21) Appl. No.: 15/298,898

(22) Filed: Oct. 20, 2016

(65) Prior Publication Data

US 2017/0116807 A1 Apr. 27, 2017

(30) Foreign Application Priority Data

Oct. 23, 2015 (JP) ..... 2015-209279
Dec. 1, 2015 (JP) ..... 2015-234951
(Continued)

(51) Int. Cl.
*G07D 3/00* (2006.01)
*G07D 1/02* (2006.01)
(Continued)

(52) U.S. Cl.
CPC ..... *G07D 1/02* (2013.01); *G07D 1/00* (2013.01); *G07D 3/00* (2013.01); *G07D 3/02* (2013.01);
(Continued)

(58) Field of Classification Search
CPC ..... G07D 1/00; G07D 3/00; G07D 9/008; G07D 9/00; G07D 9/04; G07D 9/002; G07D 9/004; G07F 3/04
(Continued)

(56) References Cited

U.S. PATENT DOCUMENTS 2,964,181 A * 12/1960 Demarest ..... A22C 29/005 209/654
3,381,694 A * 5/1968 Lempke ..... G07D 9/00 221/116
(Continued)

FOREIGN PATENT DOCUMENTS

JP 5375425 B2 12/2013

*Primary Examiner* — Jeffrey Alan Shapiro
(74) *Attorney, Agent, or Firm* — Manabu Kanesaka

(57) ABSTRACT

A coin processing apparatus houses received coins for each denomination of the coins and dispenses the housed coins in accordance with a coin output instruction. The coin processing apparatus includes: a conveyance unit that conveys the coins that are received and stored in an input section upwards one by one along a predetermined conveyance path, allows authenticity and a denomination of each coin to be checked by a checking section while the coin is conveyed, sorts the coins checked to be true coins by denomination, and dispenses the coin checked to be a false coin; and a coin output suspending unit that receives the coin dispensed from the conveyance unit, outputs the received coin from a dispensing outlet when a coin output command is given, and feeds the received coin to the input section when a feeding command is given.

4 Claims, 16 Drawing Sheets

(30) Foreign Application Priority Data

Feb. 1, 2016 (JP) ..... 2016-017291
Feb. 1, 2016 (JP) ..... 2016-017412

(51) Int. Cl.
*G07D 1/00* (2006.01)
*G07D 9/00* (2006.01)
*G07D 3/02* (2006.01)

(52) U.S. Cl.
CPC ..... *G07D 9/00* (2013.01); *G07D 9/002* (2013.01); *G07D 9/008* (2013.01)

(58) Field of Classification Search
USPC ..... 453/7, 11, 56; 235/379; 209/534; 194/206, 207
See application file for complete search history.

(56) References Cited

U.S. PATENT DOCUMENTS

| | | | | |
|---|---|---|---|---|
| 4,902,263 | A * | 2/1990 | Ito | G07D 9/00 198/392 |
| 2010/0227539 | A1* | 9/2010 | Aguado Vitas | G07D 1/00 453/56 |
| 2012/0122385 | A1* | 5/2012 | Watson | G07D 3/14 453/56 |
| 2015/0371478 | A1* | 12/2015 | Blythin | G07D 9/00 453/56 |
| 2017/0213408 | A1* | 7/2017 | Hough | G07D 1/00 |

* cited by examiner

COIN PROCESSING APPARATUS

CROSS-REFERENCE TO RELATED APPLICATIONS

The present application claims priority to and incorporates by reference the entire contents of Japanese Patent Application No. 2015-209279 filed in Japan on Oct. 23, 2015, Japanese Patent Application No. 2015-234951 filed in Japan on Dec. 1, 2015, Japanese Patent Application No. 2016-017412 filed in Japan on Feb. 1, 2016 and Japanese Patent Application No. 2016-017291 filed in Japan on Feb. 1, 2016.

BACKGROUND

1. Field of the Disclosure

The present disclosure relates to a coin processing apparatus.

2. Description of the Related Art

In the related art, an example of coin processing apparatuses applied to change machines discriminates authenticity and denominations of coins dropped in a coin inlet, and thereafter, automatically takes in the coins checked as true coins to house the coins in coin containers provided for the respective denominations of the coins. The coin processing apparatus dispenses, to a coin outlet from the coins housed in the containers, a requested amount of coins as change in accordance with a change dispensing request from an external apparatus (e.g., refer to Japanese Patent No. 5375425).

The coin processing apparatus described above has a plurality of belts each endlessly stretched between a pair of rollers and conveys coins by the multiple belts arranged such that the uppermost upstream portion of the belt on a downstream side is disposed below the lowermost downstream portion of the belt on an upstream side. Each belt needs to have a predetermined conveyance length, thereby making it difficult to downsize the coin processing apparatus.

There is a need for a compact size coin processing apparatus.

SUMMARY

It is an object of the present disclosure to at least partially solve the problems in the conventional technology.

A coin processing apparatus according to one aspect of the present disclosure houses received coins for each denomination of the coins and dispenses the housed coins in accordance with a coin output instruction. The coin processing apparatus may include: a conveyance unit that conveys the coins that are received and stored in an input section upwards one by one along a predetermined conveyance path, allows authenticity and a denomination of each coin to be checked by a checking section while the coin is conveyed, sorts the coins checked to be true coins by denomination, and dispenses the coin checked to be a false coin; and a coin output suspending unit that receives the coin dispensed from the conveyance unit, outputs the received coin from a dispensing outlet when a coin output command is given, and feeds the received coin to the input section when a feeding command is given.

A coin processing apparatus according to another aspect of the present disclosure houses received coins in a plurality of housing units for each denomination of the coins and dispenses the coins in accordance with a coin output instruction from the housing units. The coin processing apparatus may include: a conveyance unit that conveys the coins that are received and stored in an input section upwards one by one along a predetermined conveyance path, allows authenticity and a denomination of each coin to be checked by a checking section while the coin is conveyed, and sorts the coins checked to be true coins by denomination; a suspending unit that receives the coins sorted by the conveyance unit, conveys the coins to be housed to the housing units when performing housing operation, and feeds the coins to be fed to the input section when performing feeding operation; and a controller that causes the suspending unit to perform the feeding operation when it is determined that an error has occurred in the coin sorting by the conveyance unit.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

The following describes an embodiment of a coin processing apparatus according to the disclosure in detail with reference to the accompanying drawings.

Figure 1:
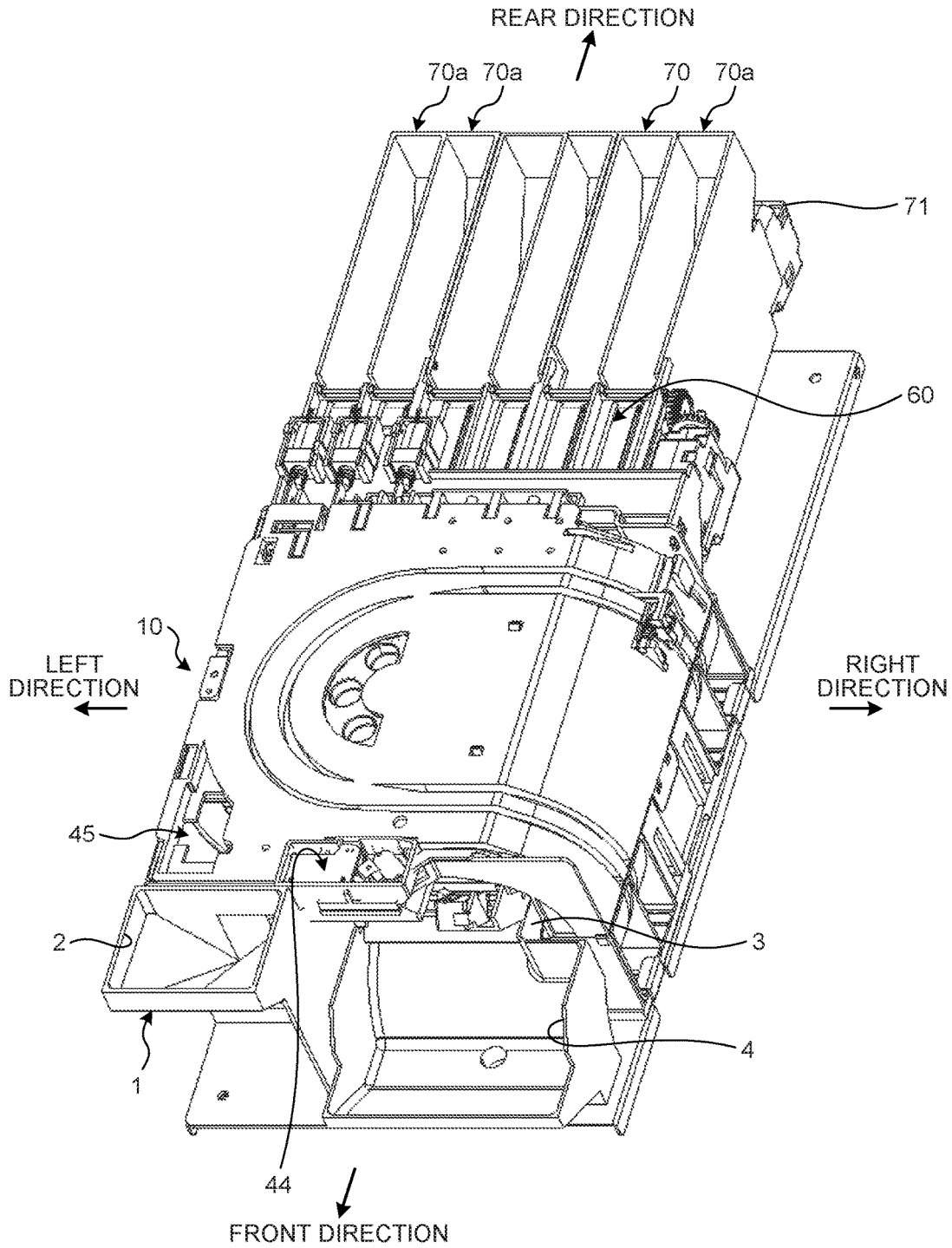
FIG. 1 is a perspective view illustrating an internal structure of a coin processing apparatus according to an embodiment of the disclosure.
Figure 2:
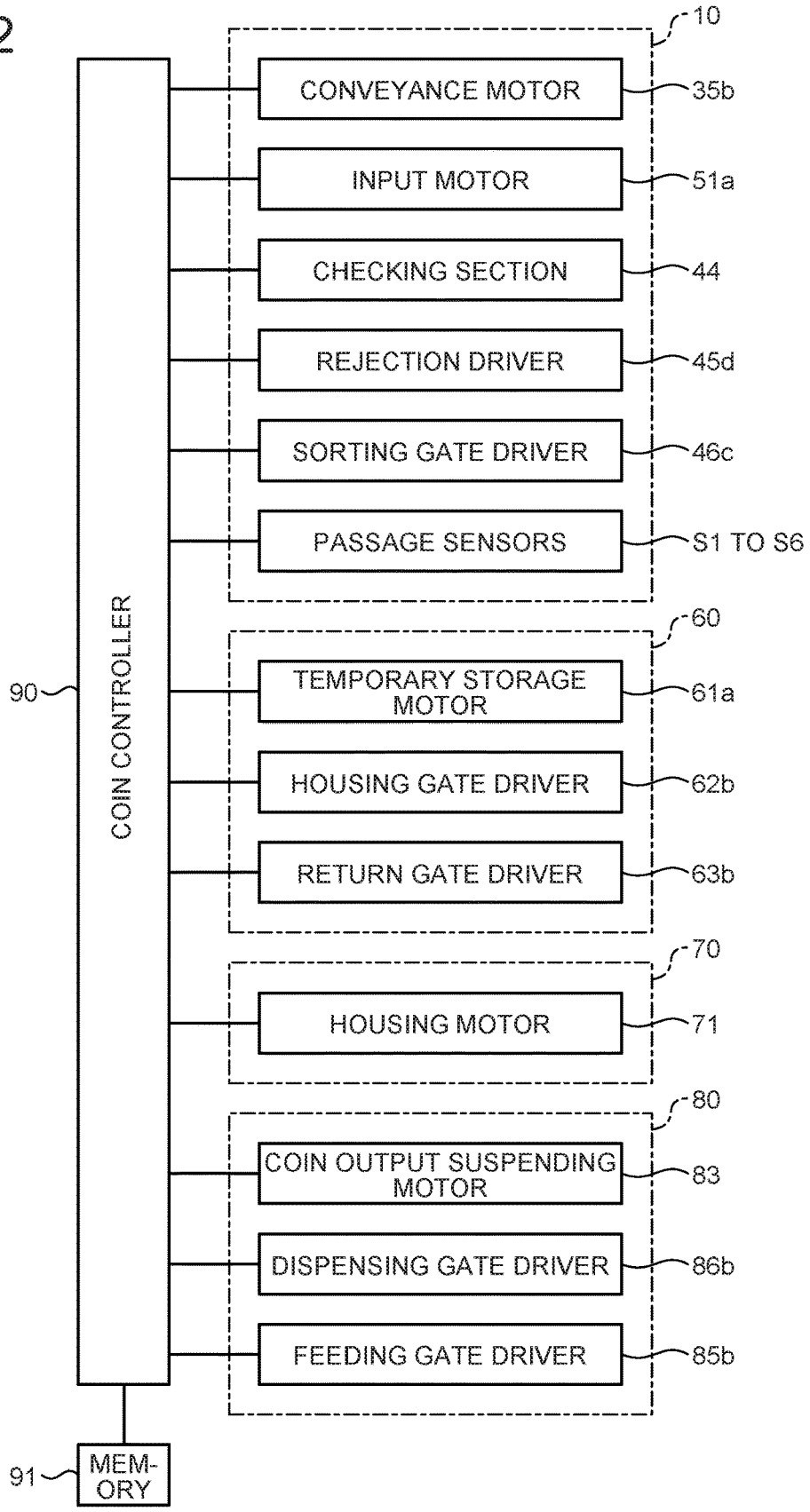
FIG. 2 is a block diagram schematically illustrating a distinctive control system of the coin processing apparatus according to the embodiment of the disclosure.

FIG. 1 is a perspective view illustrating an internal structure of the coin processing apparatus in the embodiment of the disclosure. FIG. 2 is a block diagram schematically illustrating a distinctive control system of the coin processing apparatus in the embodiment of the disclosure. The coin processing apparatus exemplified herein is applied to a change machine, for example. The coin processing apparatus includes a conveyance unit 10, a temporary storage unit 60, a housing unit 70, a coin output suspending unit 80, and a coin controller 90.

Figure 3:
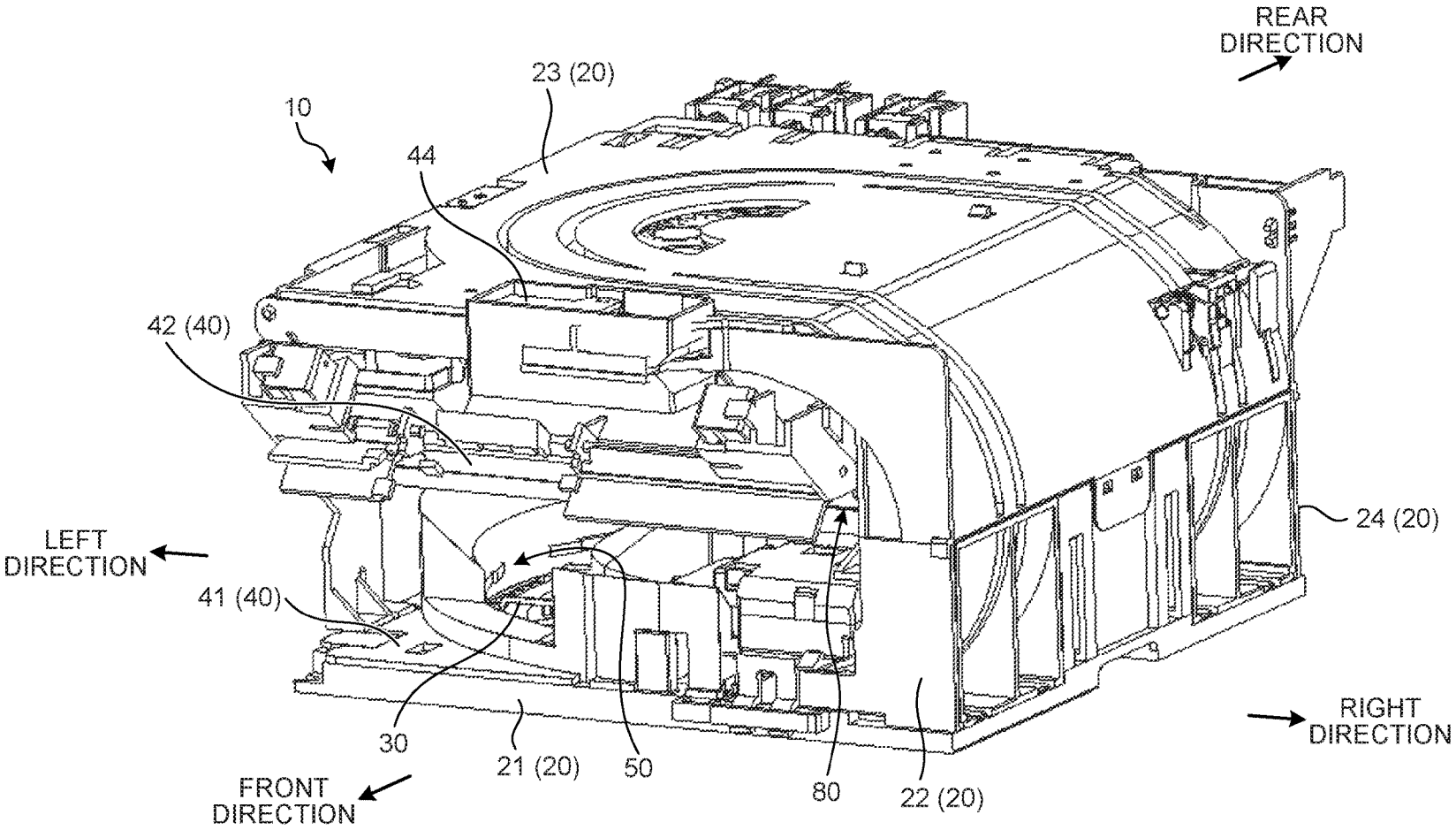
FIG. 3 is a perspective view illustrating a conveyance unit illustrated in FIG. 1.
Figure 4:
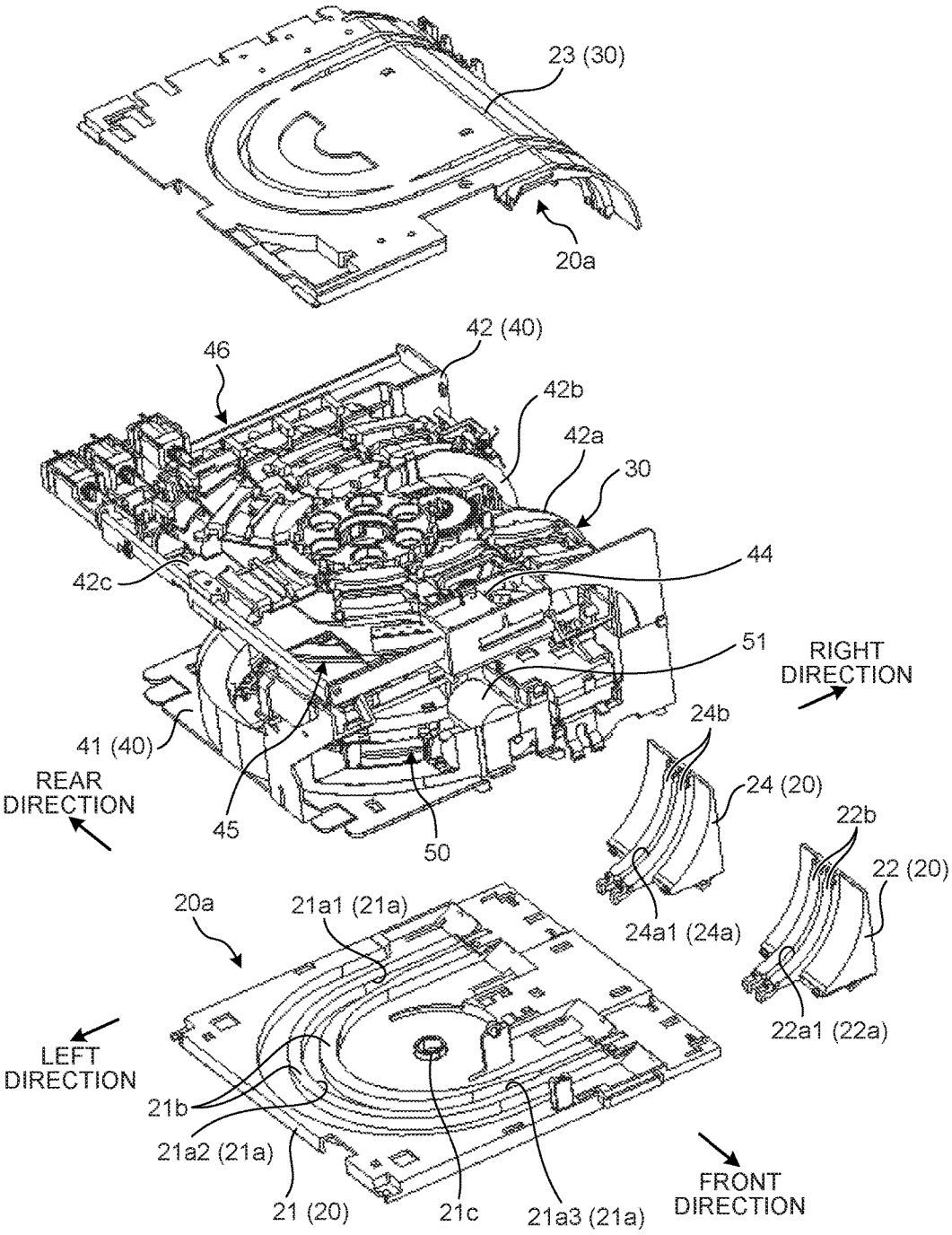
FIG. 4 is an exploded perspective view illustrating the conveyance unit illustrated in FIG. 1.
Figure 5:
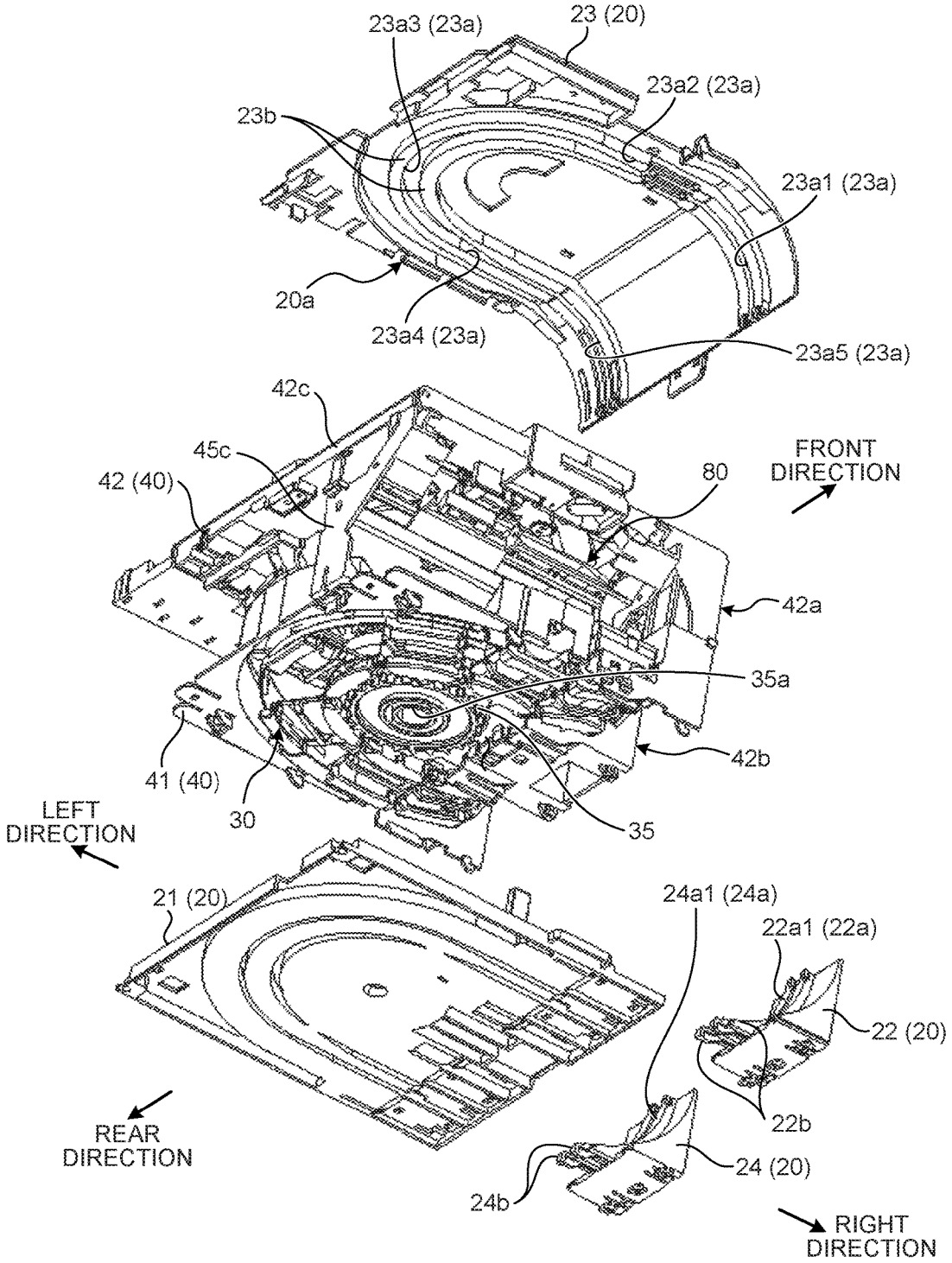
FIG. 5 is another exploded perspective view illustrating the conveyance unit illustrated in FIG. 1.

FIGS. 3 to 5 each illustrate the conveyance unit 10 illustrated in FIG. 1. FIG. 3 is a perspective view thereof. FIGS. 4 and 5 are exploded perspective views thereof. As illustrated in FIGS. 3 to 5, the conveyance unit 10 includes a rail forming section 20, a conveyance section 30, and a conveyance base 40.

The rail forming section 20 includes a first rail forming member 21, a second rail forming member 22, a third rail forming member 23, and a fourth rail forming member 24.

The first rail forming member 21 forms the bottom of the conveyance unit 10 and has a platy shape. On the upper surface of the first rail forming member 21, a first rail section 21*a* is formed. The first rail section 21*a* is shaped by a pair of long members 21*b* protruding upwards. The first rail section 21*a* is, thus, provided between the pair of long members 21*b*.

The first rail section 21*a* is continuously composed of a first rail component 21*a*1 extending in the left direction, a second rail component 21*a*2 extending in an arc shape from the extending end of the first rail component 21*a*1 in the front direction, and a third rail component 21*a*3 extending from the extending end of the second rail component 21*a*2 in the right direction.

The second rail forming member 22 has a block-like shape and the left surface thereof is curved. The second rail forming member 22 is placed at the right end on the front direction side of the first rail forming member 21. On the left surface of the second rail forming member 22, a second rail section 22*a* is formed. The second rail section 22*a* is shaped by a pair of long members 22*b* protruding from the left surface. The second rail section 22*a* is, thus, provided between the pair of long members 22*b*.

The second rail section 22*a* has a fourth rail component 22*a*1 that extends upwards in such an arc shape that the arc bulges in the right direction. As a result of placement of the second rail forming member 22 on the first rail forming member 21, the fourth rail component 22*a*1 continues to the third rail component 21*a*3.

The third rail forming member 23 forms the upper surface of the conveyance unit 10. The third rail forming member 23 has a platy shape and a part of which is curved. On the lower surface of the third rail forming member 23, a third rail section 23*a* is formed. The third rail section 23*a* is shaped by a pair of long members 23*b* protruding downwards and in the left direction. The third rail section 23*a* is, thus, provided between the pair of long members 23*b*.

The third rail section 23*a* is continuously composed of a fifth rail component 23*a*1 extending in the left direction in such an arc shape that the arc bulges upwards, a sixth rail component 23*a*2 extending in the left direction from the extending end of the fifth rail component 23*a*1, a seventh rail component 23*a*3 extending in the rear direction from the extending end of the sixth rail component 23*a*2, an eighth rail component 23*a*4 extending in the right direction from the extending end of the seventh rail component 23*a*3, and a ninth rail component 23*a*5 extending downwards in such an arc shape that the arc bulges in the right direction from the extending end of the eighth rail component 23*a*4.

The fourth rail forming member 24 has a block-like shape and the left surface thereof is curved. The fourth rail forming member 24 is placed at the rear end on the front direction side of the first rail forming member 21. On the left surface of the fourth rail forming member 24, a fourth rail section 24*a* is formed. The fourth rail section 24*a* is shaped by a pair of long members 24*b* protruding from the left surface. The fourth rail section 24*a* is, thus, provided between the pair of long members 24*b*.

The fourth rail section 24*a* has a tenth rail component 24*a*1 that extends downwards in such an arc shape that the arc bulges in the right direction. As a result of placement of the fourth rail forming member 24 on the first rail forming member 21, the tenth rail component 24*a*1 continues to the first rail component 21*a*1.

In the first rail forming member 21, the second rail forming member 22, the third rail forming member 23, and the fourth rail forming member 24, the fifth rail component 23*a*1 continues to the fourth rail component 22*a*1, and the ninth rail component 23*a*5 continues to the tenth rail component 24*a*1. As a result, the first rail section 21*a*, the second rail section 22*a*, the third rail section 23*a*, and the fourth rail section 24*a* structure a single rail section. The rail section forms a conveyance path 20*a* used for conveying coins.

Figure 6:
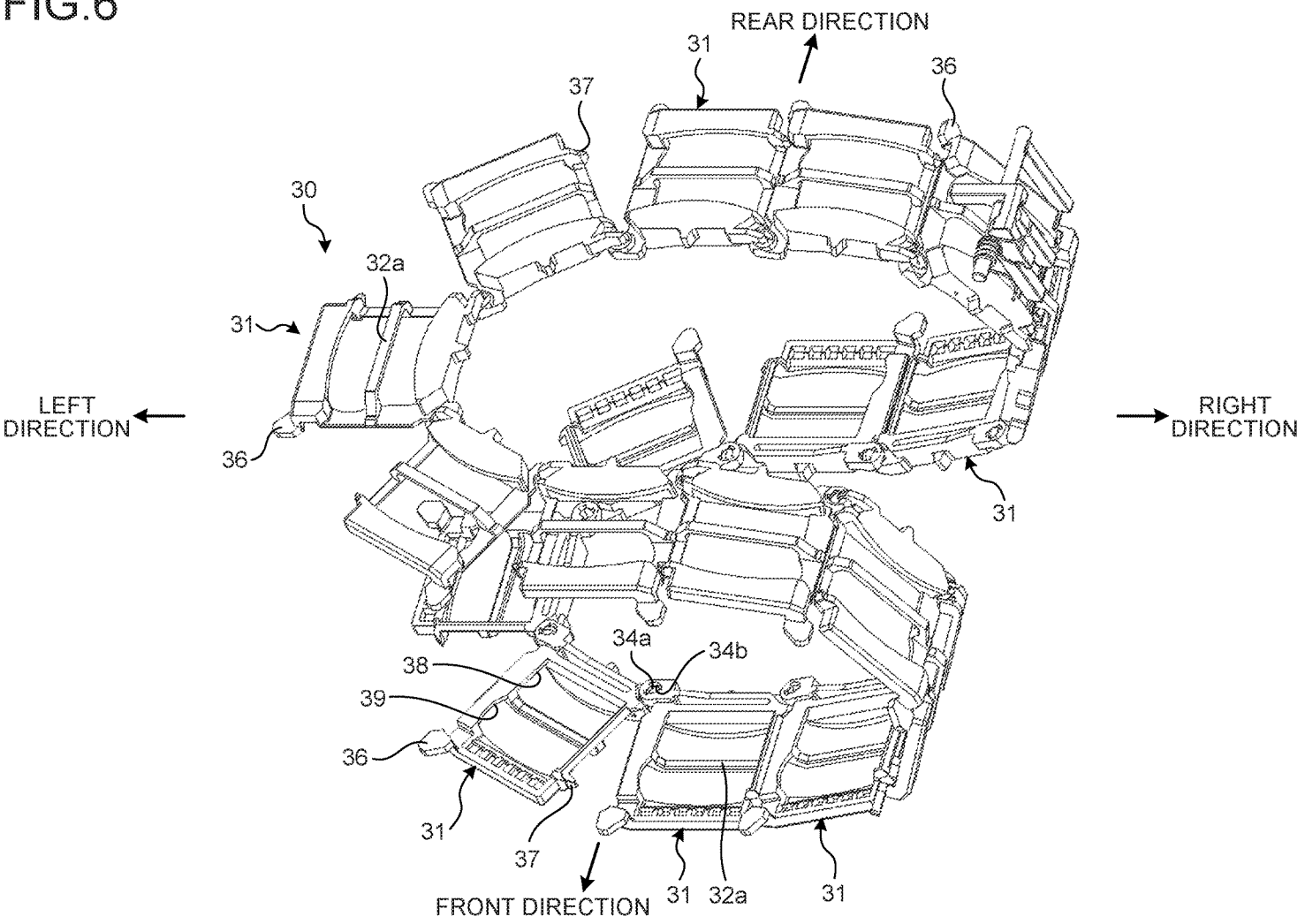
FIG. 6 is a perspective view illustrating a conveyance section included in the conveyance unit illustrated in FIGS. 1 to 4.
Figure 7:
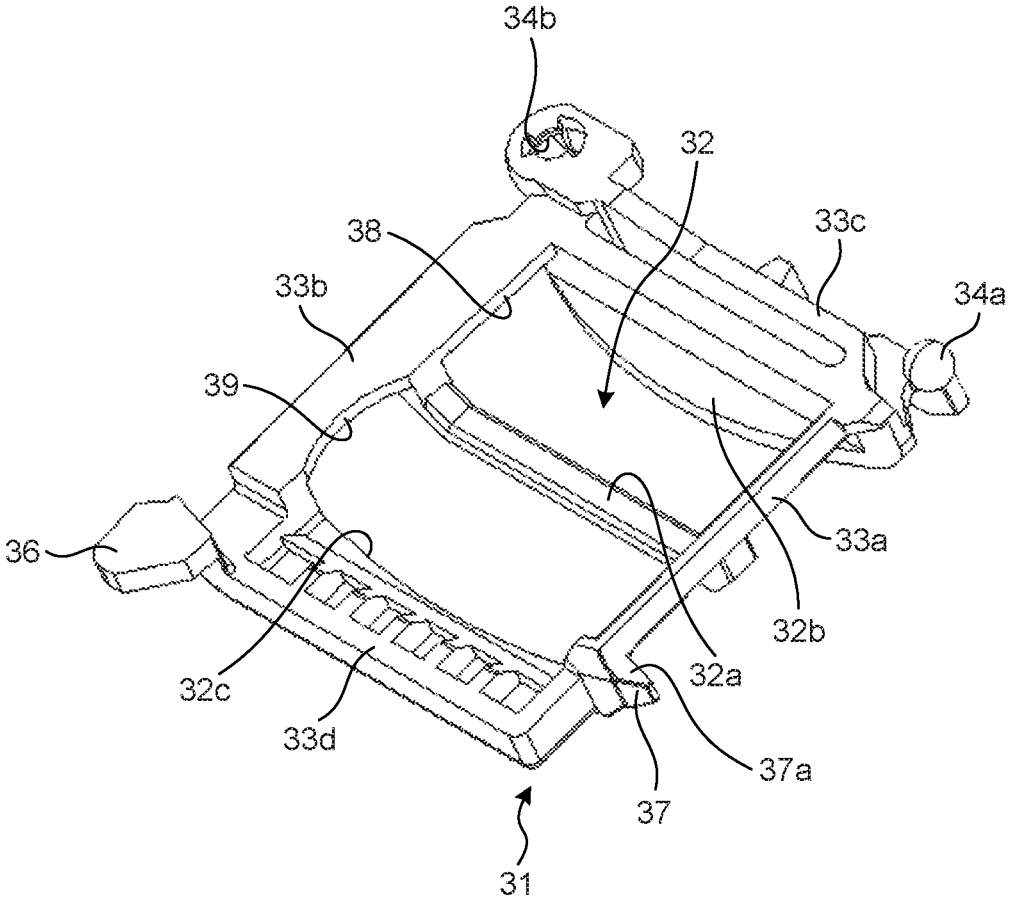
FIG. 7 is a perspective view illustrating one of holding sections included in the conveyance section illustrated in FIG. 6.

FIG. 6 is a perspective view illustrating the conveyance section 30 included in the conveyance unit 10 illustrated in FIGS. 1 to 5. As illustrated in FIG. 6, the conveyance section 30 has a plurality of holding sections 31. The holding section 31 is made of a resin material, for example. As illustrated in FIG. 7, the holding section 31 has a housing recess 32.

The housing recess 32 is a housing space in which a single coin is housed. The housing recess 32 is surrounded by a first framing portion 33*a* and a second framing portion 33*b*, which face each other, a third framing portion 33*c* connecting one end of the first framing portion 33*a* and one end of the second framing portion 33*b*, and a fourth framing portion 33*d* connecting the other end of the first framing portion 33*a* and the other end of the second framing portion 33*b* as the four peripheries thereof. The housing recess 32 has the bottom including a long protrusion 32*a* formed such that the long protrusion 32*a* is bridged between the first framing portion 33*a* and a second framing portion 32*b*, a protruding side 32*b* of the third framing portion 33*c*, and a protruding side 32*c* of the fourth framing portion 33*d*.

The holding section 31, which has the housing recess 32, has a connection protrusion 34*a* formed at one end of the third framing portion 33*c*, and a connection hole 34*b* formed at the other end of the third framing portion 33*c*. The holding sections 31 are connected to one another in such a manner that the connection protrusion 34*a* of the holding section 31 is inserted through the connection hole 34*b* of the adjacent holding section 31.

As a result of placing the long protrusions 32*a* in the rail section (the first rail section 21*a*, the second rail section 22*a*, the third rail section 23*a*, and the fourth rail section 24*a*) such that the long protrusions 32*a* may be guided, the holding sections 31 are endlessly connected to one another along the conveyance path 20*a* to structure the conveyance section 30.

The conveyance section 30 is composed of the multiple holding sections 31 endlessly connected to one another along the conveyance path 20*a*, and is capable of being displaced along the conveyance path 20*a*. In the conveyance section 30 thus structured, the third framing portion 33*c* is on an inner side of the conveyance section 30 while the fourth framing portion 33*d* is on an outer side of the conveyance section 30. The connection protrusion 34*a* and the connection hole 34*b*, which connect the adjacent holding sections 31 to each other, are provided on the inner side.

In the conveyance section 30, the long protrusions 32*a* are placed in the rail section such that they may be guided as described above. As a result, the housing recess 32 faces upwards in each of the holding sections 31 having the long protrusions 32*a* placed in the first rail component 21*a*1, the second rail component 21*a*2, and the third rail component 21*a*3. The housing recess 32 faces the left direction in each of the housing sections 31 having the long protrusions 32*a* placed in the fourth rail component 22*a*1, the fifth rail component 23*a*1, the ninth rail component 23*a*5, and the tenth rail component 24*a*1. The housing recess 32 faces downwards in each of the housing sections 31 having the long protrusions 32*a* placed in the sixth rail component 23*a*2, the seventh rail component 23*a*3, and the eighth rail component 23*a*4.

In the conveyance section 30, the holding sections 31 having the long protrusions 32*a* placed in a part of the first rail component 21*a*1 and a part of the third rail component 21*a*3, and the holding sections 31 having the long protrusions 32*a* placed in the second rail component 21*a*2 engage with a part of the outer periphery of a conveyance transmission section 35 having a disc shape. The conveyance transmission section 35 has a through hole 35*a* formed at the central portion thereof. A conveyance shaft 21*c* passes through the through hole 35*a*, thereby making it possible for the conveyance transmission section 35 to rotate around the central axis of the conveyance shaft 21*c*. The conveyance shaft 21*c* is formed on the first rail forming member 21 such that the conveyance shaft 21*c* protrudes upwards.

The conveyance transmission section 35 is connected to a conveyance motor 35*b*. The conveyance motor 35*b* may be driven to rotate in normal and reverse directions. The conveyance motor 35*b* is driven by a command given by the coin controller 90, which is described later. When the conveyance motor 35*b* is driven to rotate in the normal direction, the conveyance transmission section 35 rotates around the central axis of the conveyance shaft 21*c* in a counterclockwise direction viewed from above.

As a result, the conveyance section 30 is displaced in the following order: the first rail component 21*a*1, the second rail component 21*a*2, the third rail component 21*a*3, the fourth rail component 22*a*1, the fifth rail component 23*a*1, the sixth rail component 23*a*2, the seventh rail component 23*a*3, the eighth rail component 23*a*4, the ninth rail component 23*a*5, and the tenth rail component 24*a*1. As a result, the first framing portion 33*a* of the holding section 31 is on a downstream side in a coin conveyance direction while the second framing portion 33*b* is on an upstream side in the coin conveyance direction. When the conveyance section 30 is displaced in the manner as described above, the second framing portion 33*b* serves as a pushing portion that pushes the coin housed in the housing recess 32.

In each of the holding sections 31 included in the conveyance section 30, a pushing protrusion 36, a protrusion 37, and a concave 39 are formed in addition to the structure described above.

The pushing protrusion 36 is a tongue-shaped portion that protrudes outward at the other end of the fourth framing portion 33*d*, that is, at the end on the outer side and the upstream side in the conveyance direction of the fourth framing portion 33*d*.

The protrusion 37 is provided at the end of the first framing portion 33*a* on the outer side such that the protrusion 37 protrudes on the downstream side in the conveyance direction. The protrusion 37 has a thickness gradually reduced as it proceeds to the tip thereof. As illustrated in FIG. 7, the protrusion 37 has a tilted surface 37*a*, which is the upper surface of the protrusion 37 and gradually tilts downwards as it proceeds to the tip.

The concave 39 is formed at the end of the second framing portion 33*b* on the outer side. More specifically, an action surface 38, which faces the housing recess 32, of the second framing portion 33*b* is tilted such that the action surface 38 gradually protrudes as it proceeds to the inner side. In other words, the action surface 38 is gradually tilted on the upstream side in the conveyance direction as it proceeds to the outer side. The concave 39 is formed in a concaved shape at the end of the second framing portion 33*b* on the outer side such that the concave 39 continues to the action surface 38.

The conveyance base 40 includes a lower base member 41 and an upper base member 42. The lower base member 41 is provided such that the lower base member 41 faces the first rail forming member 21 in which a part of the conveyance section 30 is placed. On the front direction side of the lower base member 41, an input section 50 is provided.

The input section 50 communicates with a coin inlet 2 via a coin receiving guide 1. The input section 50 stores therein a plurality of coins that are received through the coin inlet 2 and pass through the coin receiving guide 1. Near the input section 50, input reverse rollers 51 are provided. The input reverse rollers 51 are provided above the holding sections 31 (a part of the conveyance section 30) having the long protrusions 32*a* placed in the third rail component 21*a*3 by being extended along the front-rear direction. The input reverse rollers 51 are coupled to an input motor 51*a* through a connection member, which is not illustrated. The input motor 51*a* is driven by a command given by the coin controller 90. Once the input motor 51*a* is driven, the input reverse rollers 51 each rotate around its shaft center.

The input reverse rollers 51 each rotate around its shaft center, abuts with the coins stored in the input section 50, and house the coins one by one in the housing recess 32 of the holding section 31 having the long protrusion 32*a* placed in a part of the conveyance section 30 being displaced, that is, the third rail component 21*a*3.

The upper base member 42 has a first curved base 42*a*, a second curved base 42*b*, and a horizontal base 42*c*.

The first curved base 42*a* is provided such that the first curved base 42*a* faces the fourth rail component 22*a*1 of the second rail forming member 22 and the fifth rail component 23*a*1 of the third rail forming member 23 in which a part of the conveyance section 30 is placed.

The second curved base 42*b* is provided such that the second curved base 42*b* faces the ninth rail component 23*a*5 of the third rail forming member 23 and the tenth rail component 24*a*1 of the fourth rail forming member 24 in which a part of the conveyance section 30 is placed.

Figure 8:
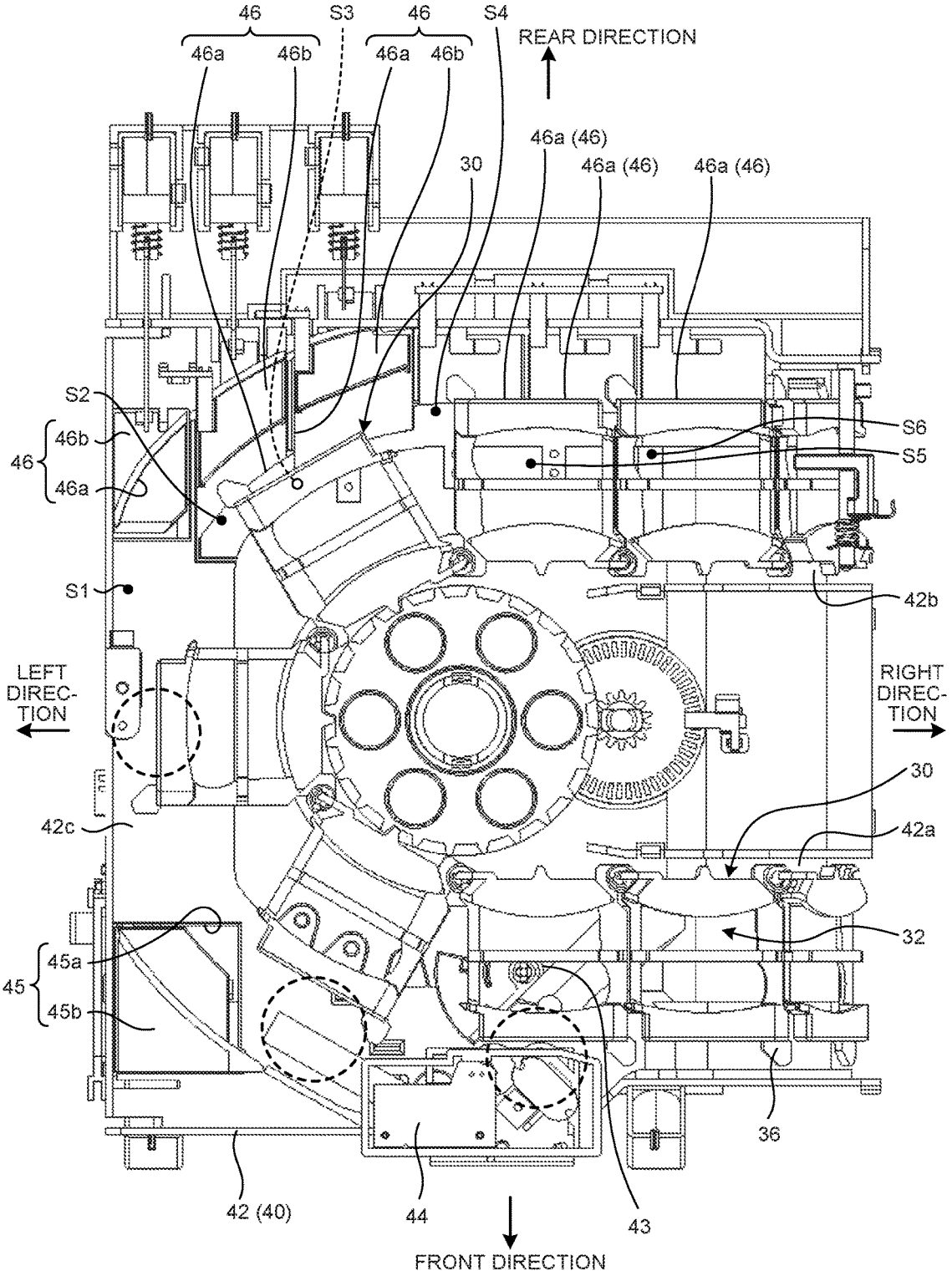
FIG. 8 is a plan view of a major portion of the conveyance unit.

The horizontal base 42*c* is provided such that the horizontal base 42*c* faces the sixth rail component 23*a*2, the seventh rail component 23*a*3, and the eighth rail component 23*a*4 of the third rail forming member 23 in which a part of the conveyance section 30 is placed. As illustrated in FIG. 8, the horizontal base 42*c* is provided with a separation slope section 43, a checking section 44, a rejection section 45, and a sorting section 46.

The separation slope section 43 is formed at a position facing the sixth rail component 23*a*2 of the rail section, and is gradually tilted forward as the separation slope section 43 proceeds to the left. The separation slope section 43 separates the coin from a part of the conveyance section 30 being displaced, that is, the housing recess 32 of the holding section 31 having the long protrusion 32*a* placed in the sixth rail component 23*a*2 to outside the holding section 31. The coin separated to outside the holding section 31, which is illustrated with the broken line in FIG. 8, is conveyed by being pushed with the pushing protrusion 36 of the holding section 31 being displaced while being in slide contact with the edge of the horizontal base 42*c*.

The checking section 44 is provided at the front end of the horizontal base 42*c*. The checking section 44 discriminates the authenticity and the denomination of the coin that is separated outside the holding section 31 by the separation slope section 43 and conveyed while being pushed with the pushing protrusion 36 of the holding section 31. A discrimination result by the checking section 44 is given to the coin controller 90 as a discrimination signal.

The rejection section 45 is provided at the left end on the front direction side of the horizontal base 42*c*. The rejection section 45 includes a rejection opening 45*a* and a rejection gate 45*b*.

The rejection opening 45*a* is formed in a rectangular shape in a conveyance region of the coin after passing through a discrimination region of the checking section 44, that is, the coin conveyed by being pushed with the pushing protrusion 36 while being in slide contact with the edge of the horizontal base 42*c*. More specifically, the rejection opening 45*a* is formed in the region where the coin after passing through the discrimination region and is conveyed while being curved to the right and being pushed with the pushing protrusion 36. The rejection opening 45*a* has a size allowing the coins of all denominations conveyed by the conveyance section 30 to pass through the rejection opening 45*a*, and communicates with the coin output suspending unit 80 via a rejection guide 45*c*.

The rejection gate 45*b* is provided such that the rejection gate 45*b* moves forward and backward with respect to the rejection opening 45*a*. When moving forward to the rejection opening 45*a*, the rejection gate 45*b* closes a part of the rejection opening 45*a* to prohibit the coin from passing through the rejection opening 45*a*.

When moving backward from the rejection opening 45*a*, the rejection gate 45*b* allows the coin to pass through the rejection opening 45*a*. As a result, the coin after passing through the rejection opening 45*a* is guided to the coin output suspending unit 80 via the rejection guide 45*c*.

The rejection gate 45*b* moves backward from the rejection opening 45*a* when a rejection driver 45*d* is driven by a command given by the coin controller 90. In a normal state, the rejection gate 45*b* moves forward to the rejection opening 45*a*.

The sorting section 46 is provided in the conveyance region of the coin conveyed by the conveyance section 30 being displaced, that is, in the conveyance region of the coin conveyed by being pushed with the pushing protrusion 36 of the holding section 31, at the rear end of the horizontal base 42*c*. As illustrated in FIG. 8, the sorting section 46 is provided with sort passing openings 46*a*, sorting gates 46*b*, and passage sensors S1 to S6.

The sort passing openings 46*a* are provided for the respective denominations side by side in the left-right direction. More specifically, from left to right, that is, from the upstream side to the downstream side in the coin conveyance direction in the coin conveyance region, the sort passing opening 46*a* for 50 yen coin, the sort passing opening 46*a* for 5 yen coin, the sort passing opening 46*a* for 500 yen coin, the sort passing opening 46*a* for 1 yen coin, the sort passing opening 46*a* for 100 yen coin, and the sort passing opening 46*a* for 10 yen coin are provided.

The sort passing opening 46*a* for 50 yen coins has a size allowing the passing through of 50 yen coins downwards. The sort passing opening 46*a* for 5 yen coins has a size allowing the passing through of 5 yen coins downwards. The sort passing opening 46*a* for 500 yen coins has a size allowing the passing through of 500 yen coins downwards. The sort passing opening 46*a* for 1 yen coins has a size allowing the passing through of 1 yen coins downwards. The sort passing opening 46*a* for 100 yen coins has a size allowing the passing through of 100 yen coins downwards. The sort passing opening 46*a* for 10 yen coins, which is provided at the most downstream side in the coin conveyance direction, has the largest opening area. The sort passing opening 46*a* for 10 yen coins has an opening size allowing the passing through of coins having a larger size than a 10 yen coin (e.g., a 500 yen coin) downwards.

The sorting gates 46*b* are provided for the respective three sort passing openings 46*a* (the sort passing opening for 50 yen coin, the sort passing opening for 5 yen coin, and the sort passing opening for 500 yen coin) on the left side such that the sorting gates 46*b* may move forward and backward with respect to the respective sort passing openings 46*a*. When moving forward to the corresponding sort passing opening 46*a*, each sorting gate 46*b* closes a part of the sort passing opening 46*a* to prohibit the coin from passing through the sort passing opening 46*a* downwards.

When moving backward from the corresponding sort passing opening 46*a*, each sorting gate 46*b* allows the coin corresponding to the sort passing opening 46*a* to pass through the sort passing opening 46*a* downwards.

Each sorting gate 46*b* moves backward from the corresponding sort passing opening 46*a* when a sorting gate driver 46*c* is driven by a command given by the coin controller 90. In a normal state, the sorting gate 46*b* moves forward to the sort passing opening 46*a*.

The passage sensors S1 to S6 are provided for the number of sort passing openings 46*a*, in the embodiment. The passage sensors S1 to S6 are provided near the respective sort passing openings 46*a* in the coin conveyance region. More specifically, the passage sensor S1 is provided on the upstream side of the sort passing opening for 50 yen coin in the coin conveyance direction. The passage sensor S2 is provided on the upstream side of the sort passing opening for 5 yen coin in the coin conveyance direction. The passage sensor S3 is provided on the upstream side of the sort passing opening for 500 yen coin in the coin conveyance direction. The passage sensor S4 is provided on the upstream side of the sort passing opening for 1 yen coin in the coin conveyance direction. The passage sensor S5 is provided on the upstream side of the sort passing opening for 100 yen coin in the coin conveyance direction. The passage sensor S6 is provided on the upstream side of the sort passing opening for 10 yen coin in the coin conveyance direction.

Each of the passage sensors S1 to S6 detects the coin passing through its detection region, that is, the conveyed coin. When detecting the coin, each of the passage sensors S1 to S6 gives the detection to the coin controller 90 as a detection signal.

The sorting section 46 thus sorts the coins passing through the sort passing openings 46*a* into the temporary storage unit 60 by denomination.

Figure 9:
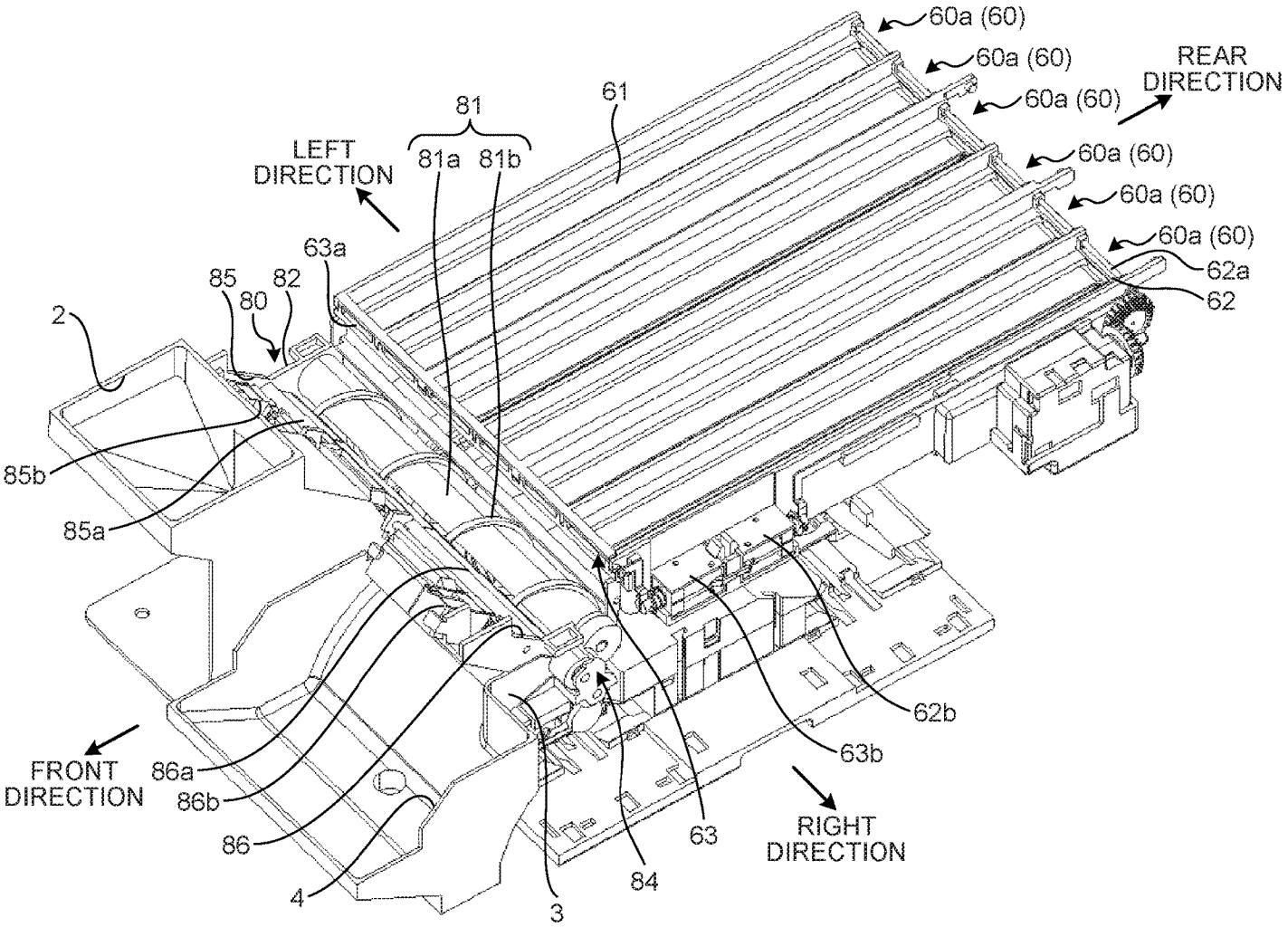
FIG. 9 is a perspective view illustrating a temporary storage unit illustrated in FIG. 1 together with a coin output suspending unit.
Figure 10:
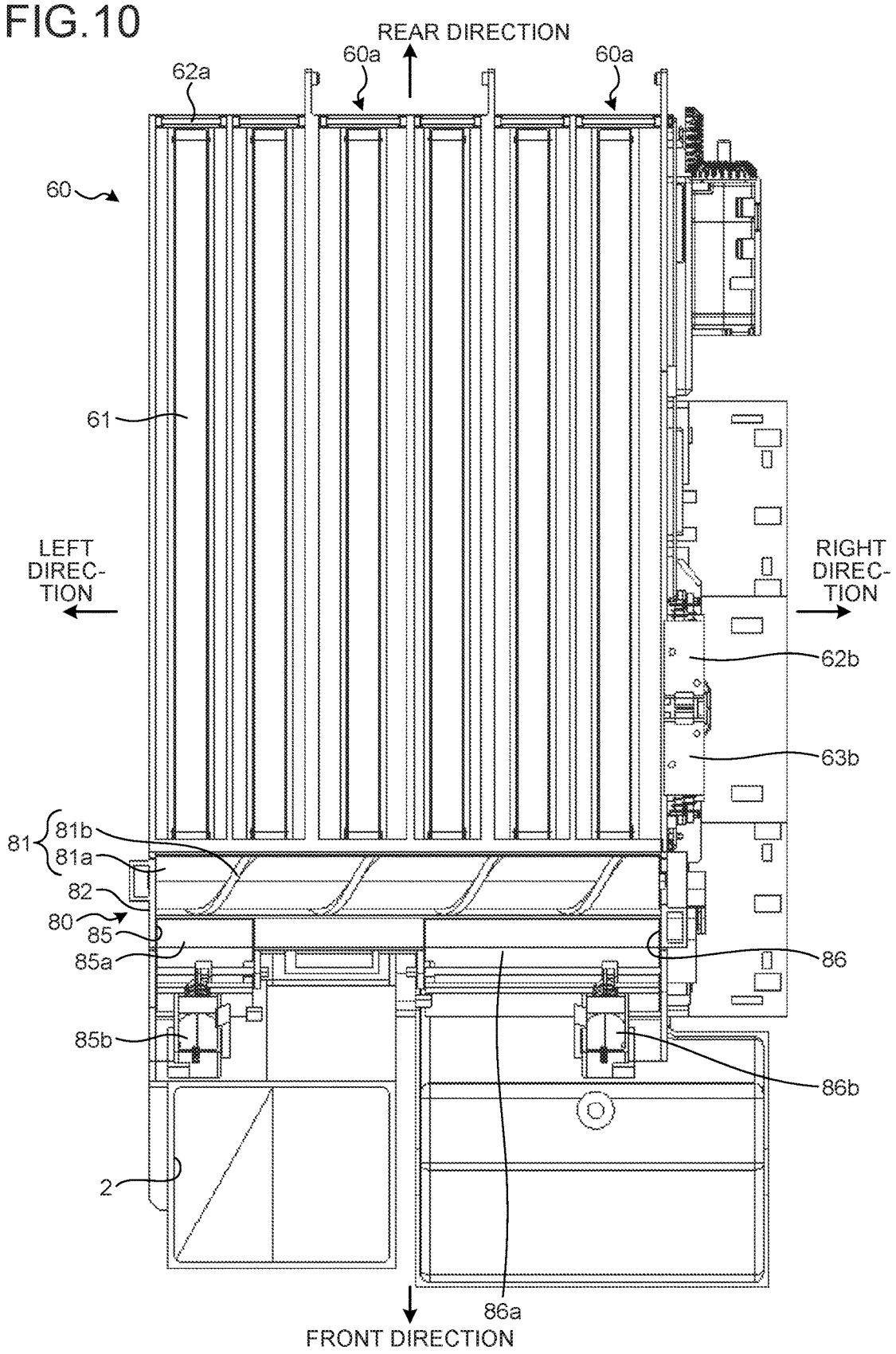
FIG. 10 is a plan view illustrating the temporary storage unit illustrated in FIG. 1 together with the coin output suspending unit.

FIGS. 9 and 10 each illustrate the temporary storage unit 60 illustrated in FIG. 1 together with the coin output suspending unit 80. FIG. 9 is a perspective view thereof. FIG. 10 is a plan view thereof.

The temporary storage unit 60 is provided with temporary storage containers 60*a* that temporarily store respective 50 yen coins, 5 yen coins, 500 yen coins, 1 yen coins, 100 yen coins, and 10 yen coins, and are sequentially arranged side by side from left to right.

The temporary storage container 60*a* for 50 yen coins is provided below the sort passing opening 46*a* for 50 yen. The temporary storage container 60*a* for 50 yen coins temporarily stores therein the coins passing through the sort passing opening 46*a* for 50 yen downwards.

The temporary storage container 60*a* for 5 yen coins is provided below the sort passing opening 46*a* for 5 yen. The temporary storage container 60*a* for 5 yen coins temporarily stores therein the coins passing through the sort passing opening 46*a* for 5 yen downwards.

The temporary storage container 60*a* for 500 yen coins is provided below the sort passing opening 46*a* for 500 yen. The temporary storage container 60*a* for 500 yen coins temporarily stores therein the coins passing through the sort passing opening 46*a* for 500 yen downwards.

The temporary storage container 60*a* for 1 yen coins is provided below the sort passing opening 46*a* for 1 yen. The temporary storage container 60*a* for 1 yen coins temporarily stores therein the coins passing through the sort passing opening 46*a* for 1 yen downwards.

The temporary storage container 60*a* for 100 yen coins is provided below the sort passing opening 46*a* for 100 yen. The temporary storage container 60*a* for 100 yen coins temporarily stores therein the coins passing through the sort passing opening 46*a* for 100 yen downwards.

The temporary storage container 60*a* for 10 yen coins is provided below the sort passing opening 46*a* for 10 yen. The temporary storage container 60*a* for 10 yen coins temporarily stores therein the coins passing through the sort passing opening 46*a* for 10 yen downwards.

Each temporary storage container 60*a* includes a conveyance belt 61 that is endlessly stretched between a pair of front and rear pulleys (not illustrated). The conveyance belt 61 is connected to a temporary storage motor 61*a*. When the temporary storage motor 61*a* is driven to rotate in a normal direction, the upper surface of the conveyance belt 61 is displaced in the rear direction while when the temporary storage motor 61*a* is driven to rotate in a reverse direction, the upper surface of the conveyance belt 61 is displaced in the front direction. The temporary storage motor 61*a* is driven by a command given by the coin controller 90.

At the rear end of each temporary storage container 60*a*, an exit 62 for housing unit is formed while at the front end of each temporary storage container 60*a*, a return opening 63 is formed. The exit 62 for housing unit is opened and closed by a housing gate 62*a* while the return opening 63 is opened and closed by a return gate 63*a*. A housing gate driver 62*b* is driven in accordance with a command by the coin controller 90 so as to open or close the housing gate 62*a*. A return gate driver 63*b* is driven in accordance with a command by the coin controller 90 so as to open or close the return gate 63*a*.

The housing unit 70 includes a plurality of coin containers 70*a* provided side by side in the left-right direction. The housing unit 70 is provided with coin containers 70*a* that house respective 50 yen coins, 5 yen coins, 500 yen coins, 1 yen coins, 100 yen coins, and 10 yen coins, and are sequentially arranged side by side from left to right. The housing unit 70 thus structured houses the coins conveyed from the temporary storage unit 60 for each denomination.

Each coin container 70*a* is provided with a housing screw-type conveyance member (not illustrated) that may rotate around its central axis. The housing screw-type conveyance member rotates by being driven by a housing motor 71. The housing motor 71 is driven by a command given by the coin controller 90.

The coin output suspending unit 80 is provided below the temporary storage unit 60 on the front direction side of the temporary storage unit 60 as well as on the front direction side of the housing unit 70. The coin output suspending unit 80 includes a coin output suspending screw-type conveyance member 81. The coin output suspending screw-type conveyance member 81 is provided to a coin output suspending guide 82 serving as a case. The coin output suspending screw-type conveyance member 81 is composed of a coin output suspending shaft 81*a* that extends in the left-right direction and has a cylindrical shape, and a coin output suspending blade member 81*b* that is spirally provided on the outer periphery of the coin output suspending shaft 81*a* such that the coin output suspending blade member 81*b* protrudes outward from the outer periphery.

The coin output suspending screw-type conveyance member 81 is coupled to a coin output suspending motor 83 with a connection member 84. The coin output suspending motor 83 is a drive source that may rotate in normal and reverse directions. The coin output suspending motor 83 is driven by a command given by the coin controller 90. When the coin output suspending motor 83 is driven to rotate in the normal direction, the coin output suspending screw-type conveyance member 81 rotates in one direction to convey the coins in the left direction while when the coin output suspending motor 83 is driven to rotate in the reverse direction, the coin output suspending screw-type conveyance member 81 rotates in the other direction to convey the coins in the right direction.

On the left side of the coin output suspending guide 82, a feeding outlet 85 is formed while on the right side of the coin output suspending guide 82, a dispensing outlet 86 is formed. The feeding outlet 85 communicates with the input section 50 via a feeding guide (not illustrated). The feeding outlet 85 is opened and closed by a feeding gate 85*a* while the dispensing outlet 86 is opened and closed by a dispensing gate 86*a*. A feeding gate driver 85*b* is driven in accordance with a command by the coin controller 90 so as to open or close the feeding gate 85*a*. A dispensing gate driver 86*b* is driven in accordance with a command by the coin controller 90 so as to open or close the dispensing gate 86*a*.

The coin controller 90 overall controls the operation of the conveyance unit 10, the temporary storage unit 60, the housing unit 70, and the coin output suspending unit 80 in accordance with a program and data stored in a memory 91.

The following describes operation of the coin processing apparatus thus structured in the embodiment. Firstly, coin receiving operation is described when coins are received via the coin inlet 2.

In this case, the received coins are stored in the input section 50 of the coin processing apparatus. After the coins are stored in the input section 50, the coin processing apparatus drives the input motor 51*a* and drives the conveyance motor 35*b* to rotate in a normal direction through the coin controller 90.

As a result of the driving of the input motor 51*a* and the conveyance motor 35*b* to rotate in the normal direction, the input reverse rollers 51 each rotate around its shaft center and the conveyance section 30 is displaced along the conveyance direction.

The input reverse rollers 51 rotate each around its shaft center, abuts with the coins stored in the input section 50, and house the coins one by one in a part of the conveyance section 30 being displaced, that is, the housing recess 32 of the holding section 31 having the long protrusion 32*a* placed in the third rail component 21*a*3. With the displacement of the conveyance section 30, the coins housed in the housing recesses 32 are conveyed upwards along the conveyance path 20*a*.

The conveyance base 40 (the upper base member 42) included in the conveyance unit 10 has the separation slope section 43 formed thereto. The conveyance unit 10 causes the coin conveyed upwards by the conveyance section 30 to come in contact with the separation slope section 43 thereby positioning the coin outside the holding section 31, and conveys the coin by pushing it with the pushing protrusion 36 while the coin is in slide contact with the edge of the horizontal base 42*c* of the upper base member 42.

The conveyance unit 10 conveys the coin by pushing it with the pushing protrusion 36 in this way. As a result, the conveyance unit 10 causes the coin to pass through the discrimination region of the checking section 44, by which the authenticity and the denomination of the coin are checked. The conveyance unit 10 thus allows the authentication and the denomination of the coin to be checked by the checking section 44 while the coin is conveyed.

When the passing coin is checked to be a true coin as a result of the discrimination by the checking section 44, the coin processing apparatus dose not drive the rejection driver 45*d* through the coin controller 90. The rejection gate 45*b* is, thus, in a state of the forward movement with respect to the rejection opening 45*a*. The coin processing apparatus, thus, causes the coin after passing through the discrimination region to pass through the rejection opening 45*a* toward the backward of the rejection opening 45*a* by the conveyance section 30 while pushing the coin with the pushing protrusion 36 of the holding section 31.

The coin processing apparatus conveys the coin after passing through the rejection opening 45*a* as described above to the sorting section 46. In the sorting section 46, the coin processing apparatus causes the coin to pass through the sort passing opening 46*a* corresponding to the denomination of the coin downwards to sort the coin. As a result of the sorting, the coin after passing through the sort passing opening 46*a* downwards is temporarily stored in the temporary storage unit 60.

Near the respective sort passing openings 46*a* in the sorting section 46, the passage sensors S1 to S6 are provided. When the coin is conveyed by the conveyance section 30, the coin is detected appropriately by the passage sensors S1 to S6.

The coin checked by the checking section 44 to be a true coin and to be a 50 yen coin passes through the sort passing opening 46*a* for 50 yen in a normal condition. Only the passage sensor S1, thus, detects the conveyance of the coin and the passage sensor S1 gives the detection signal to the coin controller 90. In other words, the coin controller 90 determines that the sorting of the coin is normal when the detection signal is given from only the passage sensor S1 while the coin controller 90 determines that an error occurs in sorting the coin when the detection signals are given from not only the passage sensor S1 but also the passage sensors S2 to S6.

The coin checked by the checking section 44 to be a true coin and to be a 5 yen coin passes through the sort passing opening 46*a* for 5 yen in a normal condition. The passage sensors S1 and S2, thus, detect the conveyance of the coin and give the detection signals to the coin controller 90. In other words, the coin controller 90 determines that the sorting of the coin is normal when the detection signals are given from the passage sensors S1 and S2 while the coin controller 90 determines that an error occurs in sorting the coin when the detection signals are given from not only the passage sensors S1 and S2 but also the passage sensors S3 to S6.

The coin checked by the checking section 44 to be a true coin and to be a 500 yen coin passes through the sort passing opening 46*a* for 500 yen in a normal condition. The passage sensors S1 to S3, thus, detect the conveyance of the coin and give the detection signals to the coin controller 90. In other words, the coin controller 90 determines that the sorting of the coin is normal when the detection signals are given from the passage sensors S1 to S3 while the coin controller 90 determines that an error occurs in sorting the coin when the detection signals are given from not only the passage sensors S1 to S3 but also the passage sensors S4 to S6.

The coin checked by the checking section 44 to be a true coin and to be a 1 yen coin passes through the sort passing opening 46*a* for 1 yen in a normal condition. The passage sensors S1 to S4, thus, detect the conveyance of the coin and give the detection signals to the coin controller 90. In other words, the coin controller 90 determines that the sorting of the coin is normal when the detection signals are given from the passage sensors S1 to S4 while the coin controller 90 determines that an error occurs in sorting the coin when the detection signals are given from not only the passage sensors S1 to S4 but also the passage sensors S5 and S6.

The coin checked by the checking section 44 to be a true coin and to be a 100 yen coin passes through the sort passing opening 46*a* for 100 yen in a normal condition. The passage sensors S1 to S5, thus, detect the conveyance of the coin and give the detection signals to the coin controller 90. In other words, the coin controller 90 determines that the sorting of the coin is normal when the detection signals are given from the passage sensors S1 to S5 while the coin controller 90 determines that an error occurs in sorting the coin when the detection signals are given from not only the passage sensors S1 to S5 but also the passage sensor S6.

The coin checked by the checking section 44 to be a true coin and to be a 10 yen coin passes through the sort passing opening 46*a* for 10 yen in a normal condition. All of the passage sensors S1 to S6, thus, detect the conveyance of the coin and give the detection signals to the coin controller 90. In other words, the coin controller 90 determines that the sorting of the coin is normal when the detection signals are given from all of the passage sensors S1 to S6 while the coin controller 90 determines that an error occurs in sorting the coin when a case occurs other than the case where the detection signals are given from all of the passage sensors S1 to S6.

The coin processing apparatus causes the temporary storage unit 60 to temporarily store therein the coins as described above, and is in a waiting state thereafter until a command such as the establishment of a transaction is given by a high-order apparatus, for example. In the waiting state, the coin processing apparatus stops the driving of the input motor 51*a* and the conveyance motor 35*b*.

When receiving the command of the establishment of the transaction from the high-order apparatus, the coin processing apparatus gives a housing command to the temporary storage unit 60 through the coin controller 90. The coin processing apparatus gives a normal rotation drive command to the temporary storage motor 61*a* and an open command to the housing gate driver 62*b* through the coin controller 90.

The commands cause the upper surface of the conveyance belt 61 to be displaced in the rear direction and the exit 62 for housing unit to open. As a result, the coins in the temporary storage container 60*a* are dispensed to the housing unit 70 to be stored in the housing unit 70. The coin receiving operation of the received coins via the coin inlet 2 ends.

The following describes coin output operation of the coins stored in the housing unit 70 when a coin output instruction is given by the high-order apparatus.

In this case, the coin processing apparatus gives a drive command to the housing motor 71 of the coin container 70*a* corresponding to the denomination through the coin controller 90 to rotate the corresponding housing screw-type conveyance member. As a result, the corresponding coins are dispensed to the coin output suspending unit 80 from the housing unit 70.

The coin processing apparatus gives a coin output command to the coin output suspending unit 80 through the coin controller 90. The coin processing apparatus gives a reverse rotation drive command to the coin output suspending motor 83 and the open command to the dispensing gate driver 86*b* through the coin controller 90.

The commands cause the coin output suspending motor 83 to be driven to rotate in the reverse direction to cause the coin output suspending screw-type conveyance member 81 to rotate in the other direction and the dispensing gate 86*a* to be displaced to open the dispensing outlet 86. The coins in the coin output suspending unit 80 are conveyed in the right direction and thereafter dispensed to a coin output tray 3 via the dispensing outlet 86. The coins dispensed to the coin output tray 3, thus, may be taken out via a coin outlet 4. The coin output operation ends.

When the passing coin is checked to be a false coin as a result of the discrimination by the checking section 44 in the coin receiving operation, the coin processing apparatus drives the rejection driver 45*d* through the coin controller 90. As a result, the rejection gate 45*b* moves backwards from the rejection opening 45*a*. This movement causes the coin after passing through the discrimination region of the checking section 44 to pass through the rejection opening 45*a* downwards, and dispenses the coin to the coin output suspending unit 80 via the rejection guide 45*c*.

When the number of backward movements of the rejection gate 45*b* in the coin receiving operation is equal to or smaller than the predetermined set number of times (e.g., three times), that is, when the number of times the checking section 44 discriminates the coin to be a false coin is equal to or smaller than the set number of times, the coin controller 90 performs the following coin reception retry control processing.

Figure 11:
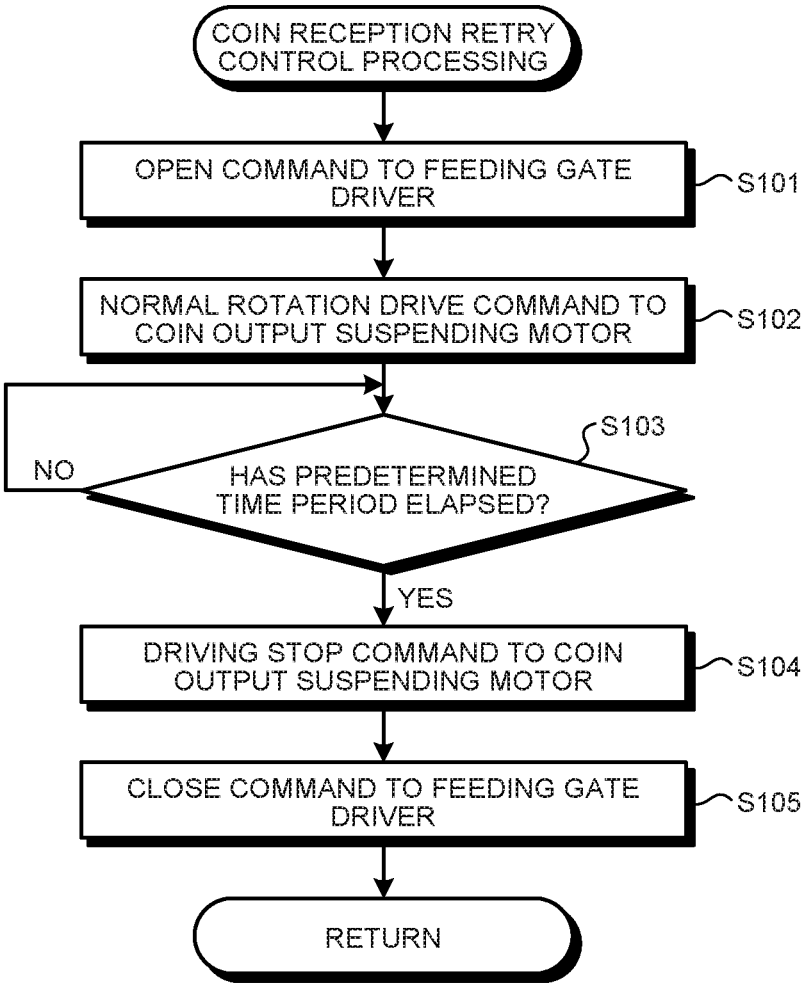
FIG. 11 is a flowchart illustrating a procedure of coin reception retry control processing performed by a coin controller.

FIG. 11 is a flowchart illustrating a procedure of the coin reception retry control processing performed by the coin controller 90.

In the coin reception retry control processing, the coin controller 90 gives a feeding command to the coin output suspending unit 80. The coin controller 90 gives the open command to the feeding gate driver 85*b* and the normal rotation drive command to the coin output suspending motor 83 (step S101 and step S102).

The commands causes the feeding gate 85*a* to move and the feeding outlet 85 to open, and the coin output suspending motor 83 to be driven to rotate in the normal direction to cause the coin output suspending screw-type conveyance member 81 to rotate in one direction. As a result, the coin in the coin output suspending unit 80 is conveyed in the left direction and fed to the input section 50 via the feeding outlet 85.

If a predetermined time period elapses (Yes at step S103), the coin controller 90 gives a driving stop command to the coin output suspending motor 83 and a close command to the feeding gate driver 85*b* (step S104 and step S105). Thereafter, the procedure is returned and the processing ends.

The coin reception retry control processing makes it possible for the coin checked to be a false coin by the checking section 44 to be conveyed by the conveyance section 30 and to be checked again by the checking section 44.

When the number of backward movements of the rejection gate 45*b* in the coin receiving operation is larger than the predetermined set number of times (e.g., three times), that is, when the number of times the checking section 44 discriminates the coin to be a false coin is larger than the set number of times, the coin controller 90 performs the following received coin return control processing.

Figure 12:
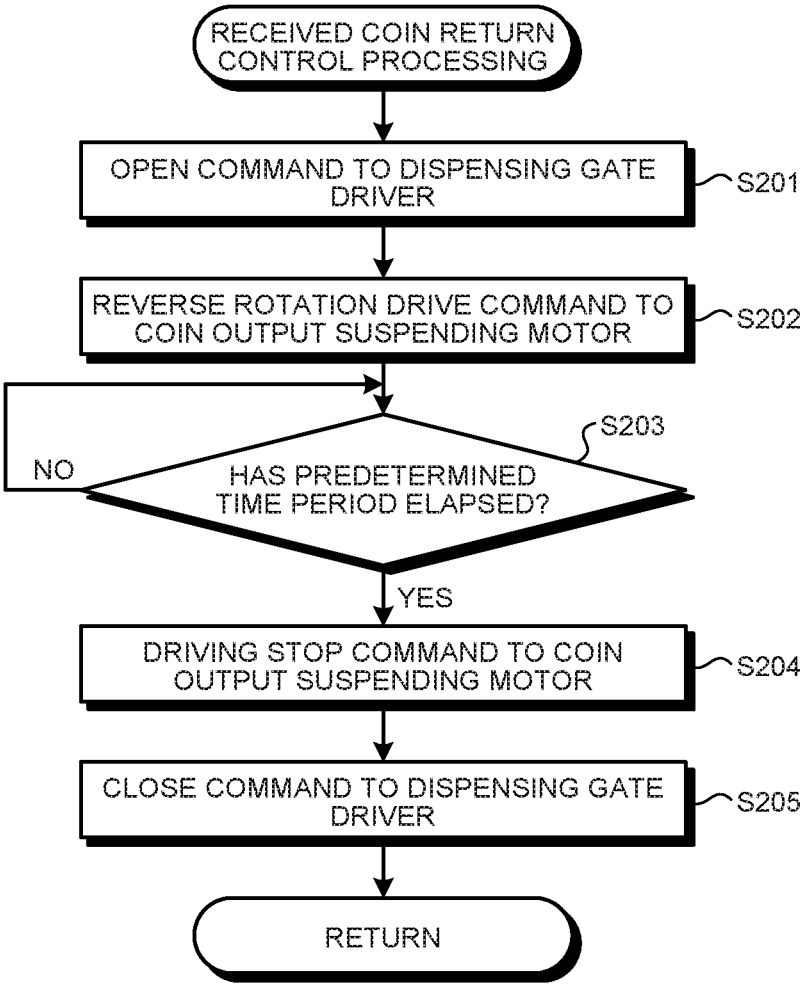
FIG. 12 is a flowchart illustrating a procedure of received coin return control processing performed by the coin controller.

FIG. 12 is a flowchart illustrating a procedure of the received coin return control processing performed by the coin controller 90.

In the received coin return control processing, the coin controller 90 gives the coin output command to the coin output suspending unit 80. The coin controller 90 gives the open command to the dispensing gate driver 86*b* and the reverse rotation drive command to the coin output suspending motor 83 (step S201 and step S202).

The commands cause the dispensing gate 86*a* to move and the dispensing outlet 86 to open, and the coin output suspending motor 83 to be driven to rotate in the reverse direction to cause the coin output suspending screw-type conveyance member 81 to rotate in the other direction. As a result, the coin in the coin output suspending unit 80 is conveyed in the right direction and fed to the coin output tray 3 via the dispensing outlet 86. The coin, thus, may be taken out via the coin outlet 4.

If a predetermined time period elapses (Yes at step S203), the coin controller 90 gives the driving stop command to the coin output suspending motor 83 and the close command to the dispensing gate driver 86*b* (step S204 and step S205). Thereafter, the procedure is returned and the processing ends.

When determining that an error has occurred in sorting the coin in the coin receiving operation, the coin controller 90 performs the following feeding control processing.

Figure 13:
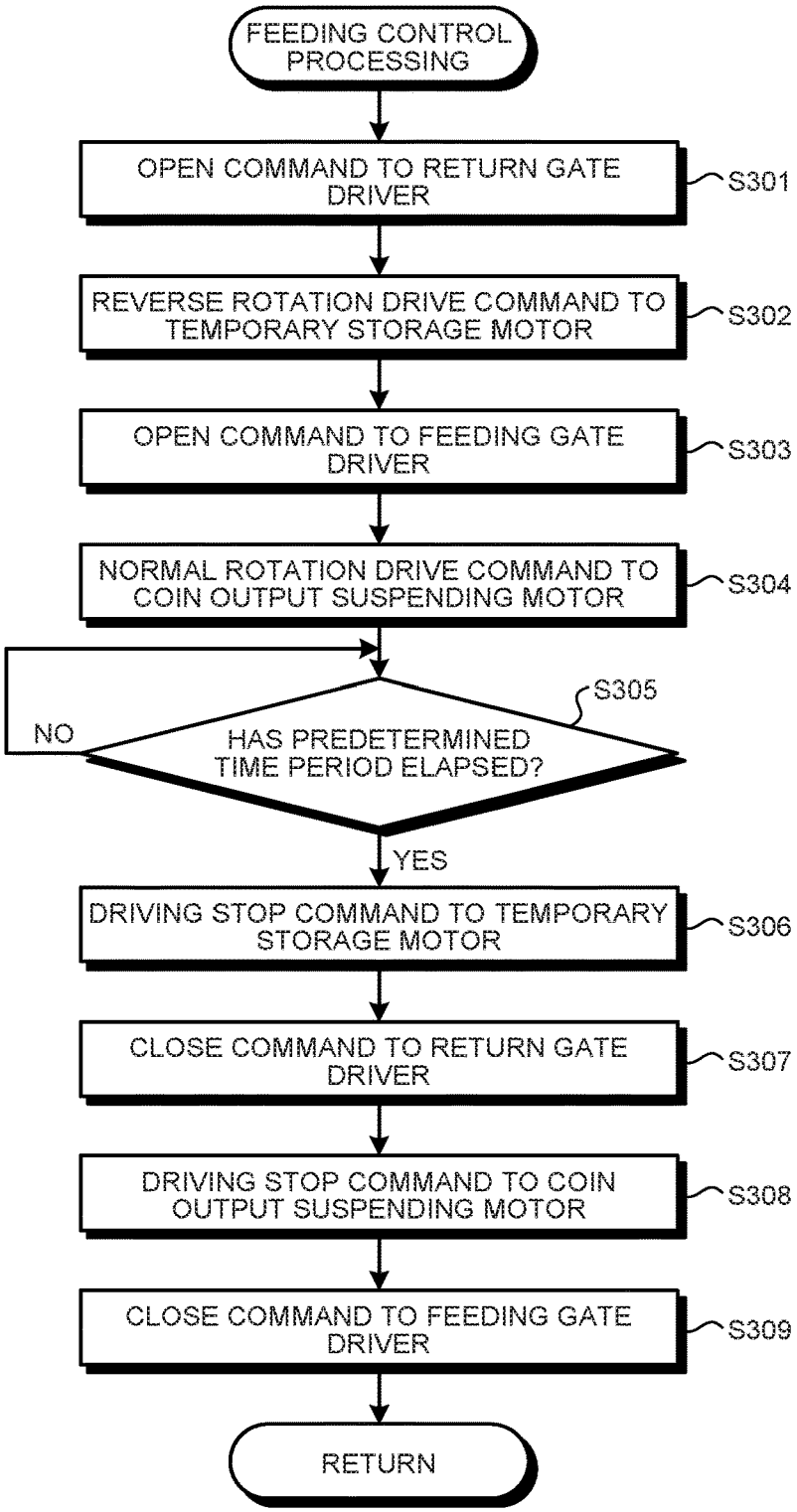
FIG. 13 is a flowchart illustrating a procedure of feeding control processing performed by the coin controller.

FIG. 13 is a flowchart illustrating a procedure of the feeding control processing performed by the coin controller 90.

In the feeding control processing, the coin controller 90 gives a return command to the temporary storage container 60*a* to which the coin is wrongly sorted. The coin controller 90 gives the open command to the return gate driver 63*b* and the reverse rotation drive command to the temporary storage motor 61*a* (step S301 and step S302).

The commands cause the return gate 63*a* to move and the return opening 63 to open, and the temporary storage motor 61*a* to be driven to rotate in the reverse direction to cause the upper surface of the conveyance belt 61 to be displaced in the front direction. As a result, the coin stored in the temporary storage container 60*a* is fed to the coin output suspending unit 80.

After step S301 and step S302, the coin controller 90 gives the feeding command to the coin output suspending unit 80. Specifically, the coin controller 90 gives the open command to the feeding gate driver 85*b* and the normal rotation drive command to the coin output suspending motor 83 (step S303 and step S304).

The commands cause the feeding gate 85*a* to move and the feeding outlet 85 to open, and the coin output suspending motor 83 to be driven to rotate in the normal direction to cause the coin output suspending screw-type conveyance member 81 to rotate in one direction. As a result, the coin in the coin output suspending unit 80 is conveyed in the left direction and fed to the input section 50 via the feeding outlet 85.

If a predetermined time period elapses (Yes at step S305), the coin controller 90 gives the driving stop command to the temporary storage motor 61*a* and the close command to the return gate driver 63*b* (step S306 and step S307). Furthermore, the coin controller 90 gives the driving stop command to the coin output suspending motor 83 and the close command to the feeding gate driver 85*b* (step S308 and step S309). Thereafter, the procedure is returned and the processing ends.

The feeding control processing makes it possible for the coin that has been wrongly sorted to be conveyed by the conveyance section 30 and to be checked again by the checking section 44.

In the coin processing apparatus in the embodiment, the conveyance unit 10 conveys upwards the coins received via the coin inlet 2 and stored in the input section 50 one by one along the predetermined conveyance path 20*a*, allows the authenticity and the denominations of each of the coins to be checked by the checking section 44 while the coin is conveyed, and sorts the coins checked to be true coins by denomination. The area of the coin processing apparatus, thus, may be more reduced than a conventional coin processing apparatus that conveys the coins using a plurality of belts each endlessly stretched between a pair of rollers. As a result, the coin processing apparatus in the embodiment may be achieved in a compact size.

In the coin processing apparatus, the conveyance section 30 included in the conveyance unit 10 is composed of the multiple holding sections 31, which are endlessly connected to one another and each of which may hold a single coin, and is displaced along the rail section forming the conveyance path 20*a*. As a result, the coin processing apparatus may stably convey the coins. When the conveyance section 30 causes the coin to pass through the discrimination region of the checking section 44, the conveyance section 30 conveys the coin by pushing it with the pushing protrusion 36 provided to the holding section 31 while the coin is positioned outside the holding section 31. The checking section 44, thus, may successfully discriminate the coin.

In the coin processing apparatus, when the coin output command is given to the coin output suspending unit 80, the coin received from the conveyance unit 10 is output via the dispensing outlet 86 while when the feeding command is given to the coin output suspending unit 80, the coin received from the conveyance unit 10 is fed to the input section 50. The coin processing apparatus, thus, may convey the coin checked to be a false coin by the checking section 44 by the conveyance section 30, and discriminate the coin again by the checking section 44, thereby making it possible to prevent the coin that is a true coin from being output as a false coin.

In the coin processing apparatus, when the coin controller 90 determines that an error occurs in sorting the coin, the corresponding coin stored in the temporary storage unit 60 is fed to the input section 50 via the coin output suspending unit 80. The coin processing apparatus, thus, may convey the coin by the conveyance section 30 and discriminate the coin again by the checking section 44, thereby making it possible to house the coin wrongly sorted in the desired housing unit 70.

Particularly, in the coin processing apparatus in the embodiment, the sort passing opening 46*a* for 10 yen coins, which is provided at the most downstream side in the coin conveyance direction, has the largest opening area. The sort passing opening 46*a* for 10 yen coins has an opening size allowing the passing through of coins having a larger size than a 10 yen coin (e.g., a 500 yen coin). The coin processing apparatus, thus, allows coins that may not pass through the desired sort passing opening 46*a* to pass through the sort passing opening 46*a* for 10 yen coins, thereby making it possible to prevent the occurrence of a jam of coins by the conveyance section 30 due to a coin that may not pass through any of all the sort passing openings 46*a*.

In the coin processing apparatus, the protrusion 37 of the holding section 31 makes it possible to place the coin disposed between the holding section 31 and the adjacent holding section 31 on the tilted surface 37*a* to guide the coin in the housing recess 32 of the holding section 31 as a result of the displacement of the conveyance section 30 in the conveyance direction. The coin processing apparatus, thus, may prevent the occurrence of another jam of coins.

In the coin processing apparatus, the action surface 38 of the second framing portion 33*b* of the holding section 31 is tilted such that the action surface 38 gradually protrudes as it proceeds to the inner side. The coin housed in the housing recess 32, thus, may be positioned on the outer side as a result of the displacement of the conveyance section 30 in the conveyance direction. The separation slope section 43 of the conveyance base 40, thus, may reliably position the coin outside the holding section 31. This makes it possible for the separation slope section 43 to position the coin outside the holding section 31 even when a displacement speed of the conveyance section 30 is increased. The coin processing apparatus, thus, may increase capacity to process coins.

Particularly, the concave 39 is formed at the end on the outer side of the second framing portion 33*b* such that the concave 39 continues to the action surface 38. As a result, the coin is easily separated by the separation slope section 43 to be positioned outside the holding section 31. In addition, the concave 39 formed in a curved shape may prevent the coin from coming up while being conveyed.

In the coin processing apparatus, the rejection opening 45*a* is formed in the region where the coin after passing through the discrimination region is conveyed while being curved to the right and being pushed with the pushing protrusion 36. In the region, a sufficient distance between the coins held by the adjacent holding sections 31 may be kept. This makes it possible to reliably dispense only the coin checked to be a false coin even when the displacement speed of the conveyance section 30 is increased.

The present disclosure is not limited to the embodiment described above, and may be changed in various ways.

In the embodiment, the dispensing outlet 86 is normally closed by the dispensing gate 86*a*. In the disclosure, the dispensing outlet 86 may be open in a normal state. In this case, the coin processing apparatus drives the housing motor 71 corresponding to the denomination of the coin serving as the target of the coin output instruction to rotate in one direction through the coin controller 90 and drives the coin output suspending motor 83 to rotate in the other direction.

The coin processing apparatus drives the predetermined housing motor 71 to rotate in one direction, thereby sequentially dispensing the predetermined number of coins according to the coin output instruction to the coin output suspending unit 80 by the housing screw-type conveyance member in the corresponding coin container 70*a*.

In the coin output suspending unit 80 to which the coins are dispensed from the corresponding coin container 70*a*, the coin output suspending screw-type conveyance member 81 is caused to rotate in the other direction by the coin output suspending motor 83 driven to rotate in the other direction, thereby conveying the coins dispensed to the coin output suspending unit 80 in the right direction. The coins are dispensed to the coin output tray 3 via the dispensing outlet 86, which is open. The coin output operation ends. Thereafter, the respective motors are stopped.

When an abnormality occurs such as a case where the number of coins dispensed from the corresponding coin container 70*a* is larger than the number of coins instructed by the coin output instruction, the coin controller 90 of the coin processing apparatus performs the following output coin number correction processing.

Figure 14:
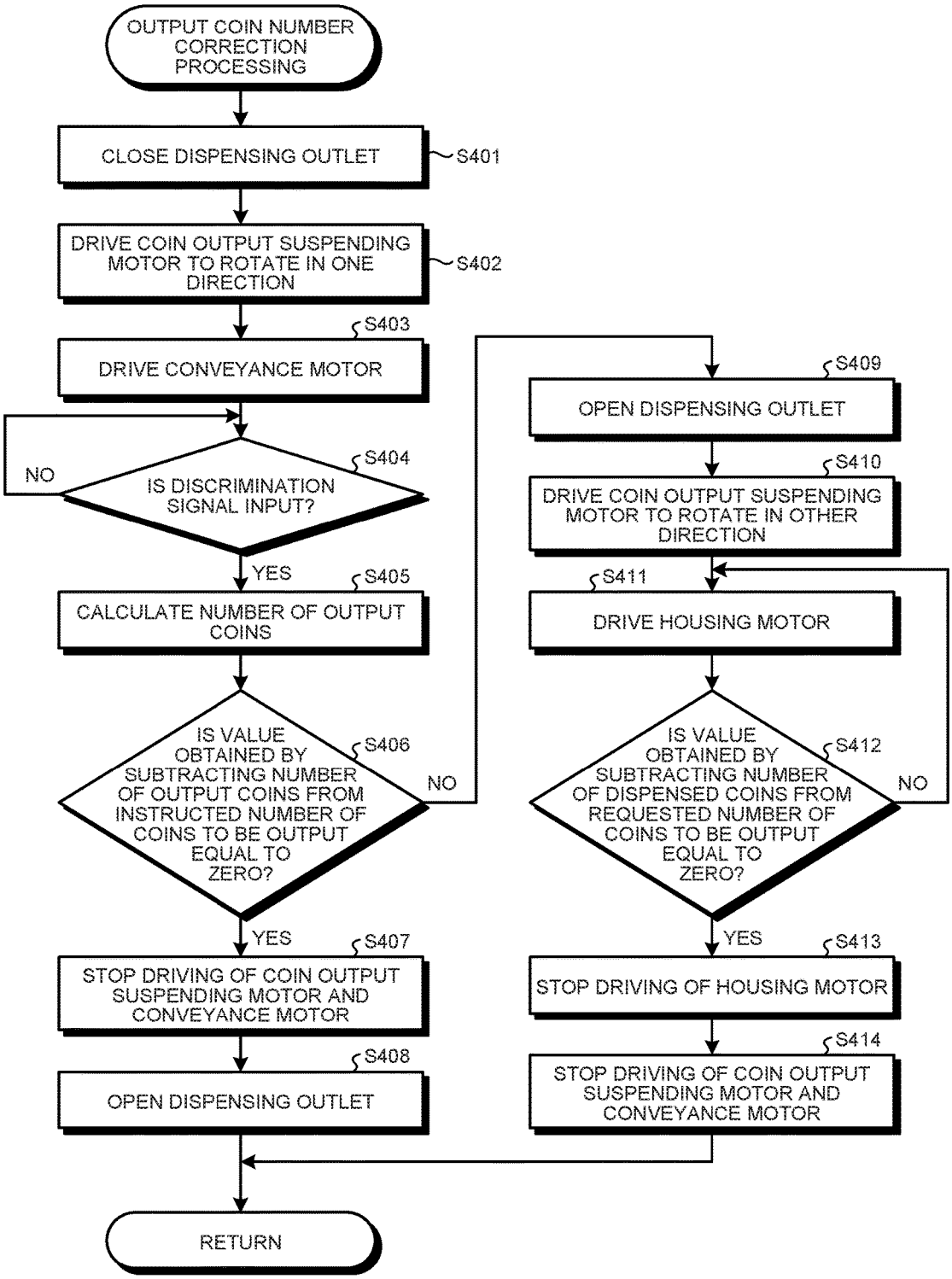
FIG. 14 is a flowchart illustrating a procedure of output coin number correction processing performed by the coin controller illustrated in FIG. 2.

FIG. 14 is a flowchart illustrating a procedure of the output coin number correction processing performed by the coin controller 90 illustrated in FIG. 2.

In the output coin number correction processing, the coin controller 90 drives the dispensing gate driver 86*b* to close the dispensing outlet 86 (step S401), and thereafter, drives the coin output suspending motor 83 to rotate in one direction, and drives the conveyance motor 35*b* (step S402 and step S403).

The closing of the dispensing outlet 86 may prevent all of the coins dispensed to the coin output suspending unit 80 from being fed to the coin output tray 3 via the dispensing outlet 86. The coin output suspending motor 83 driven to rotate in one direction causes the coin output suspending screw-type conveyance member 81 to rotate in one direction. As a result, the coins in the coin output suspending unit 80 are conveyed in the left direction to be dispensed to the input section 50 from the feeding outlet 85. In addition, the conveyance section 30 is displaced by the driven conveyance motor 35*b*. As a result, the conveyance section 30 may convey the coins dispensed to the input section 50 one by one.

After the processing at step S403, the coin controller 90 waits for input of the discrimination signal from the checking section 44 (step S404). If the discrimination signal is input from the checking section 44 (Yes at step S404), the coin controller 90 calculates the number of output coins by subtracting the number of coins included in the discrimination signal (the measured number of coins) from the number of coins detected by a dispensing sensor (not illustrated) (the number of coins dispensed from the coin container 70*a*) (step S405). The calculation, which subtracts the number of coins measured by the checking section 44 from the number coins dispensed from the coin container 70*a*, may calculate the number of coins already dispensed to the coin output tray 3.

After the calculation of the number of output coins as described above, the coin controller 90 determines whether the number of output coins is equal to the number of coins instructed by the coin output instruction as the output (step S406). If the number of output coins is equal to the number of coins instructed by the coin output instruction (Yes at step S406), then the coins the number of which is equal to that instructed by the coin output instruction are already dispensed to the coin output tray 3. The coin controller 90, thus, stops the driving of the coin output suspending motor 83 and the conveyance motor 35*b*, and then drives the dispensing gate driver 86*b* to open the dispensing outlet 86 (step S407 and step S408). Thereafter, the procedure is returned and the processing ends.

The output coin number correction processing makes it possible to collect the coins dispensed extra than the number of coins instructed by the coin output instruction, and, after the collection, makes it possible to house the extra coins in the corresponding coin container 70*a* by driving the temporary storage motor 61*a*.

If the number of output coins is unequal to the number of coins instructed by the coin output instruction (No at step S406), the number of coins dispensed to the coin output tray 3 (the number of output coins) is smaller than that instructed by the coin output instruction. The coin controller 90, thus, drives the dispensing gate driver 86*b* to open the dispensing outlet 86 (step S409). The coin controller 90 drives the coin output suspending motor 83 to rotate in the other direction and drives the housing motor 71 of the corresponding coin container 70*a* (step S410 and step S411). As a result, the coins are dispensed to the coin output suspending unit 80 from the coin container 70*a*, and thereafter the coins are dispensed to the coin output tray 3 via the dispensing outlet 86.

The coin controller 90 determines whether the number of coins dispensed from the coin container 70*a* (the number of dispensed coins) is equal to the number of coins requested to be output (the number obtained by subtracting the number of coins already output from the number coins instructed by the coin output instruction) (step S412). If the number of dispensed coins is equal to the number of coins requested to be output, the coin controller 90 stops the driving of the housing motor 71 and thereafter stops the driving of the coin output suspending motor 83 and the conveyance motor 35*b* (step S413 and step S414). Thereafter, the procedure is returned and the processing ends.

The output coin number correction processing may newly dispense the number of coins that is equal to the number of coins insufficient to the number of coins instructed by the coin output instruction.

In the coin processing apparatus thus structured, when the coin output command is given, the coins are dispensed from the corresponding coin container 70*a* to the coin output suspending unit 80 while the dispensing outlet 86 is open. The coins dispensed from the coin container 70*a*, thus, may be directly fed to the coin output tray 3 via the dispensing outlet 86. As a result, a time taken to output coins may be reduced. When an abnormality occurs such as a case where the number of coins dispensed from the corresponding coin container 70*a* is larger than the number of coins instructed by the coin output instruction, the dispensing outlet 86 is closed by the dispensing gate 86*a* and the coins dispensed from the coin container 70*a* are fed to the conveyance unit 10. Consequently, the coins dispensed extra than the number of coins that is instructed by the coin output instruction may be collected while the coins insufficient to the number of coins that is instructed by the coin output instruction may be newly dispensed.

In the disclosure, a sorting section 460, which is described below, may be used instead of the sorting section 46.

Figure 15:
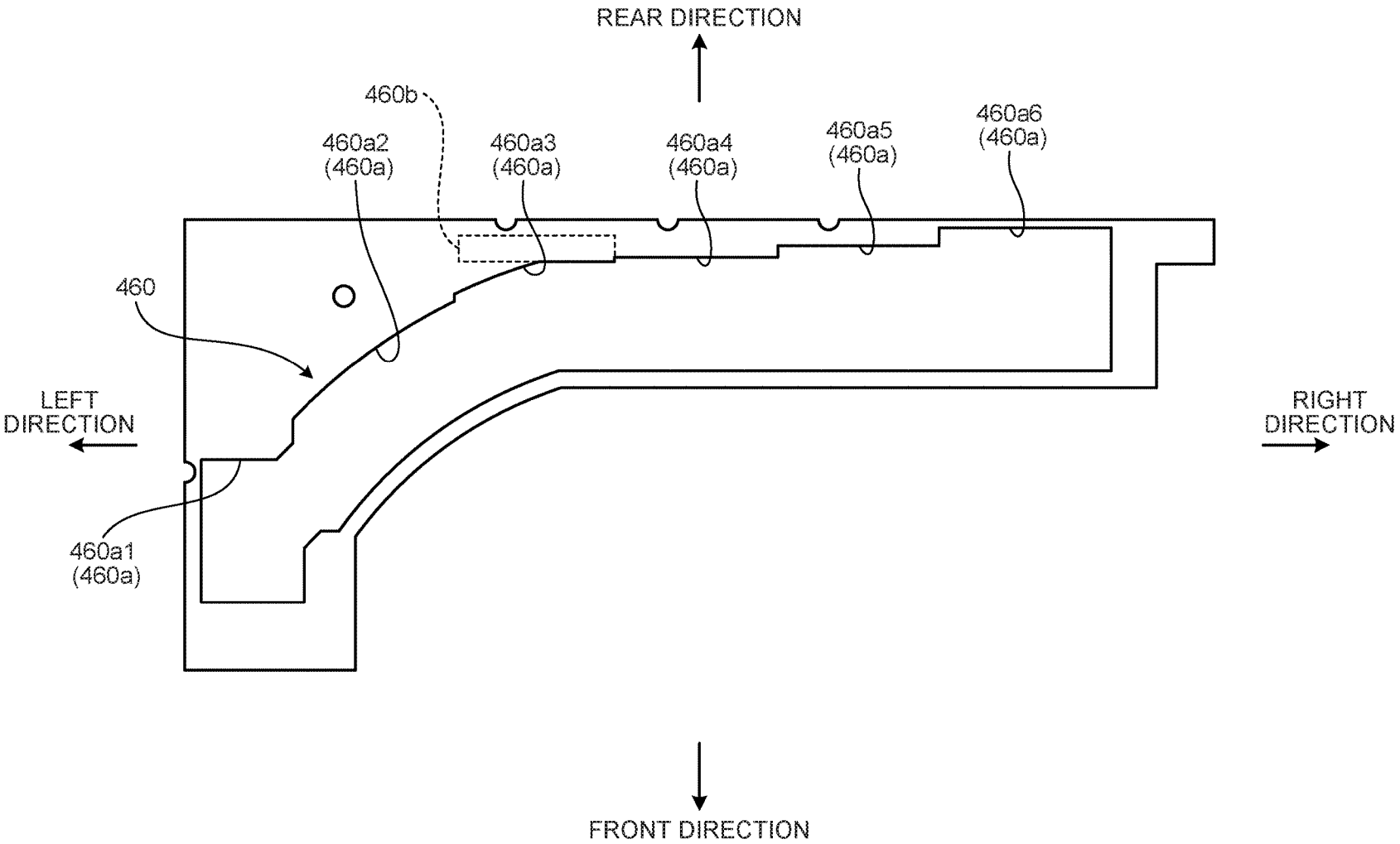
FIG. 15 is an explanatory view schematically illustrating a structure of a modification of a sorting section illustrated in FIG. 8.
Figure 16:
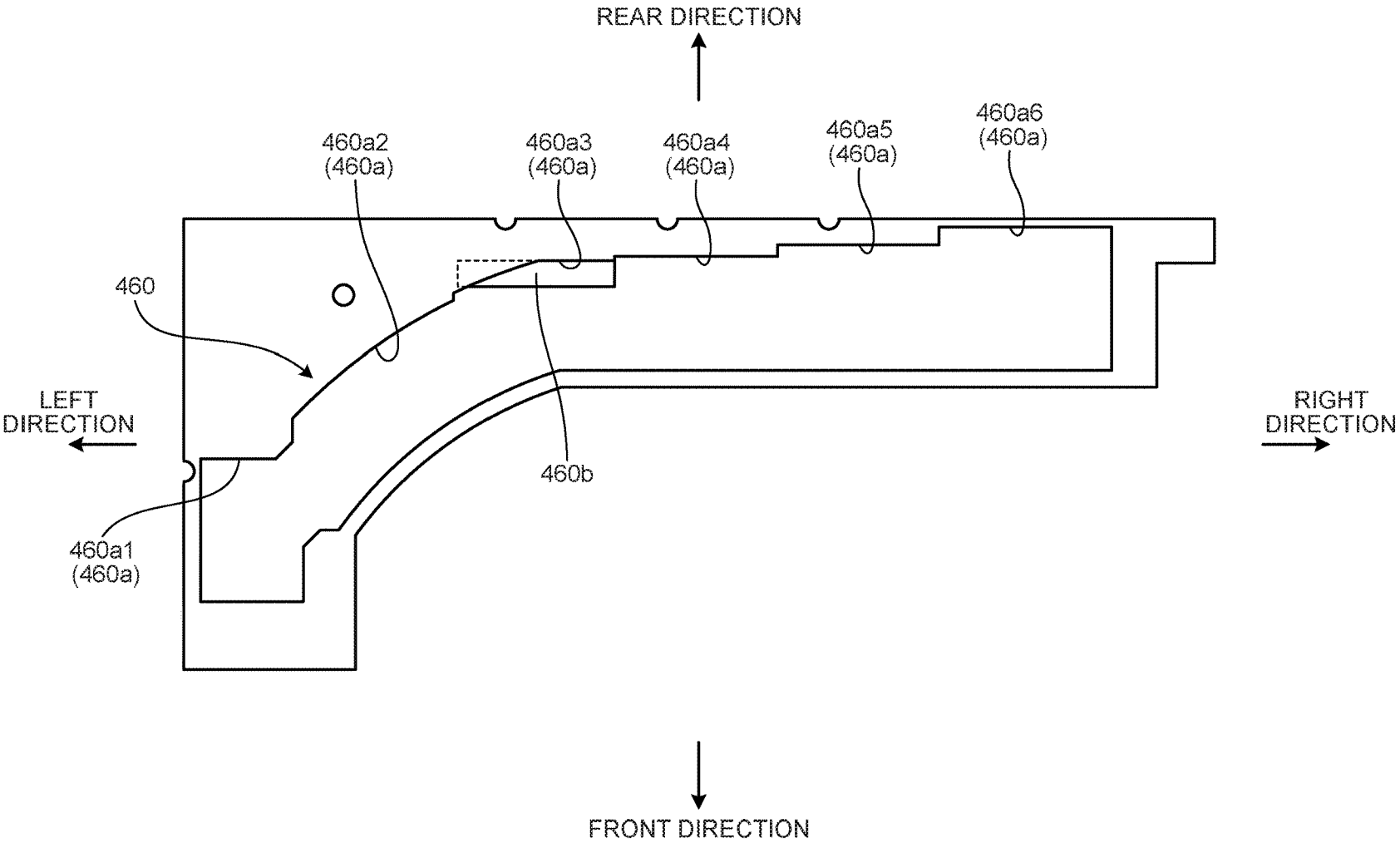
FIG. 16 is another explanatory view schematically illustrating the structure of the modification of the sorting section illustrated in FIG. 8.

The sorting section 460 is provided in the conveyance region of the coin conveyed by the conveyance section 30 being displaced, that is, in the conveyance region of the coin conveyed by being pushed with the pushing protrusion 36 of the holding section 31, at the rear end of the horizontal base 42*c*. As illustrated in FIGS. 15 and 16, the sorting section 460 is provided with a sort passing opening 460*a*, and a sorting gate 460*b*.

The sort passing opening 460*a* has openings 460*a*1 to 460*a*6 that are provided for respective denominations and arranged continuously side by side in the ascending order of outer diameters of coins in relation to the denominations. More specifically, the sort passing opening 460*a* is an opening formed by openings having different shapes in the following manner: from left to right, that is, from the upstream side to the downstream side in the coin conveyance direction in the coin conveyance region, an opening 460*a*1 for 1 yen coins, an opening 460*a*2 for 50 yen coins, an opening 460*a*3 for 5 yen coins, an opening 460*a*4 for 100 yen coins, an opening 460*a*5 for 10 yen coins, and an opening 460*a*6 for 500 yen coins are formed such that they communicate with one another.

The opening 460*a*1 for 1 yen coins has a size sufficient to allow the passing through of 1 yen coins downwards and prohibits the passing through of coins having a larger outer diameter than that of 1 yen coins (50 yen coins, 5 yen coins, 100 yen coins, 10 yen coins, and 500 yen coins) downwards. The opening 460*a*2 for 50 yen coins has a size sufficient to allow the passing through of 50 yen coins downwards and prohibits the passing through of coins having a larger outer diameter than that of 50 yen coins (5 yen coins, 100 yen coins, 10 yen coins, and 500 yen coins) downwards. The opening 460*a*3 for 5 yen coins has a size sufficient to allow the passing through of 5 yen coins downwards and prohibits the passing through of coins having a larger outer diameter than that of 5 yen coins (100 yen coins, 10 yen coins, and 500 yen coins) downwards. The opening 460*a*4 for 100 yen coins has a size sufficient to allow the passing through of 100 yen coins downwards and prohibits the passing through of coins having a larger outer diameter than that of 100 yen coins (10 yen coins and 500 yen coins) downwards. The opening 460*a*5 for 10 yen coins has a size sufficient to allow the passing through of 10 yen coin downwards and prohibits the passing through of coins having a larger outer diameter than that of 10 yen coins (500 yen coins) downwards. The opening 460*a*6 for 500 yen coins has a size sufficient to allow the passing through of 500 yen coins downwards.

The sorting gate 460*b* is provided to the opening 460*a*3 for 5 yen coins such that the sorting gate 460*b* may move forward and backward. The sorting gate 460*b* moves backward from the opening 460*a*3 for 5 yen coins by being driven by a gate driver (not illustrated) when the coin passing through the checking section 44 is checked to be the same material (e.g., cupronickel) as 100 yen coin as a result of the discrimination of the denomination by the checking section 44 (refer to FIG. 15). In contrast, when the coin passing through the checking section 44 is checked to be a different material from that of a 100 yen coin by the checking section 44, the sorting gate 460*b* moves forward to the opening 460*a*3 for 5 yen coins by being driven by the gate driver (refer to FIG. 16). When moving forward to the opening 460*a*3 for 5 yen coins, the sorting gate 460*b* prohibits 5 yen coins to pass through the opening 460*a*3 for 5 yen coins downwards.

The sorting section 460 thus structured sorts the coins passing through the sort passing opening 460*a* downwards into the temporary storage unit 60 provided below the sorting section 460 by denomination.

In the coin processing apparatus thus structured, the sorting gate 460*b* included in the sorting section 460 of the conveyance unit 10 moves forward to the opening 460*a*3 for 5 yen coins when the coin having the same material as a 100 yen coin is conveyed by the conveyance section 30. The coin processing apparatus, thus, may prevent a 100 yen coin conveyed from passing through the opening 460*a*3 for 5 yen coins, which corresponds to a 5 yen coin having an outer diameter extremely different from that of a 100 yen coin. In contrast, the sorting gate 460*b* moves backward from the opening 460*a*3 for 5 yen coins when the coin having a different material from that of a 100 yen coin is conveyed by the conveyance section 30. The coin processing apparatus, thus, may cause a 5 yen coin conveyed by the conveyance section 30 to pass through the opening 460*a*3 for 5 yen coins. As a result, the coin processing apparatus may increase accuracy in sorting coins.

In the coin processing apparatus of the disclosure, the conveyance unit conveys upwards the coins that are received and stored in the input section one by one along a predetermined conveyance path, allows the authenticity and the denomination of the coin to be checked by the checking section in the conveyance, and sorts the coins checked to be true coins by denomination. The area of the coin processing apparatus may be more reduced than a conventional coin processing apparatus that conveys the coins using a plurality of belts each endlessly stretched between a pair of rollers. The disclosure has an advantageous effect of making it possible to achieve the coin processing apparatus in a compact size.

In the coin processing apparatus of the disclosure, when the coin output command is given, the coin output suspending unit outputs the coin received from the conveyance unit via the dispensing outlet while when the feeding command is given, the coin output suspending unit feeds the coin received from the conveyance unit to the input section. The coin processing apparatus, thus, may convey the coin checked to be a false coin by the checking section by the conveyance section, and discriminate the coin again by the checking section. The disclosure has an advantageous effect of making it possible to prevent the coin that is a true coin from being dispensed as a false coin.

In the coin processing apparatus of the disclosure, when it is determined that an error occurs in sorting the coin, the controller causes the coin output suspending unit to perform the feeding operation that feeds the corresponding coin to the input section. The coin processing apparatus, thus, may convey the coin by the conveyance section and discriminate the coin again by the checking section. The disclosure has an advantageous effect of making it possible to house the wrongly sorted coin in the desired housing unit.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A coin processing apparatus that houses received coins for each denomination of the coins and dispenses the housed coins in accordance with a coin output instruction, the coin processing apparatus comprising:

a conveyance unit that conveys the coins that are received and stored in an input section upwards one by one along a predetermined conveyance path, allows authenticity and a denomination of each coin to be checked by a checking section while the coin is conveyed, sorts the coins checked to be true coins by denomination, and dispenses the coin checked to be a false coin; and a coin output suspending unit that receives the coin dispensed from the conveyance unit, outputs the received coin from a dispensing outlet when a coin output command is given, and feeds the received coin to the input section when a feeding command is given, wherein the coin output suspending unit receives the coins dispensed from a plurality of coin containers housing the coins for each denomination of the coins, outputs the coins dispensed from the coin containers from a dispensing outlet by normally opening the dispensing outlet in a normal state, and feeds the coins dispensed from the coin containers to the conveyance unit by closing the dispensing outlet when an abnormality occurs in dispensing the coins from the coin containers, and the coin output suspending unit includes a screw-type conveyance member having a blade member spirally provided on an outer periphery of a cylindrical shaft such that the blade member protrudes outward from the outer periphery, outputs the coins dispensed from the coin containers from the dispensing outlet by rotating the screw-type conveyance member in one direction around a central axis of the shaft in a normal state, and feeds the coins dispensed from the coin containers to the conveyance section by rotating the screw-type conveyance member in the other direction around the central axis of the shaft when an abnormality occurs in dispensing the coins from the coin containers.

2. The coin processing apparatus according to claim 1, wherein the conveyance unit includes:

a rail section that forms the conveyance path; and a conveyance section that is composed of a plurality of holding sections and displaced along the rail section, the holding sections being endlessly connected to one another, each holding section being capable of holding one of the coins.

3. A coin processing apparatus that houses received coins in a plurality of housing units for each denomination of the coins and dispenses the coins in accordance with a coin output instruction from the housing units, the coin processing apparatus comprising:

a conveyance unit that conveys the coins that are received and stored in an input section upwards one by one along a predetermined conveyance path, allows authenticity and a denomination of each coin to be checked by a checking section while the coin is conveyed, and sorts the coins checked to be true coins by denomination;

a suspending unit that receives the coins sorted by the conveyance unit, conveys the coins to be housed to the housing units when performing housing operation, and feeds the coins to be fed to the input section when performing feeding operation; and a controller that causes the suspending unit to perform the feeding operation when it is determined that an error has occurred in the coin sorting by the conveyance unit, wherein the suspending unit includes:

a coin output suspending unit that receives the coins dispensed from the housing units in accordance with the coin output instruction; and a temporary storage unit that receives the coins sorted by the conveyance unit for each denomination of the coins, conveys the coins to the respective housing units when a housing command is given by the controller, and outputs the corresponding coins to the coin output suspending unit when a return command is given by the controller, the coin output suspending unit includes a screw-type conveyance member having a blade member spirally provided on an outer periphery of a cylindrical shaft such that the blade member protrudes outward from the outer periphery, outputs the dispensed coins from a dispensing outlet by rotating the screw-type conveyance member in one direction around a central axis of the shaft when a coin output command is given by the controller, and feeds the dispensed coins to the input section by rotating the screw-type conveyance member in the other direction around the central axis of the shaft when a feeding command is given by the controller.

4. The coin processing apparatus according to claim 3, wherein the conveyance unit includes:

a rail section that forms the conveyance path; and a conveyance section that is composed of a plurality of holding sections and displaced along the rail section, the holding sections being endlessly connected to one another, each holding section being capable of holding one of the coins.

* * * * *